US011662670B2

(12) United States Patent
Hama et al.

(10) Patent No.: US 11,662,670 B2
(45) Date of Patent: May 30, 2023

(54) TONER

(71) Applicant: CANON KABUSHIKI KAISHA, Tokyo (JP)

(72) Inventors: Masayuki Hama, Ibaraki (JP); Ichiro Kanno, Chiba (JP); Kentaro Kamae, Kanagawa (JP); Takeshi Hashimoto, Ibaraki (JP); Hayato Ida, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 103 days.

(21) Appl. No.: 17/118,960

(22) Filed: Dec. 11, 2020

(65) Prior Publication Data

US 2021/0181650 A1 Jun. 17, 2021

(30) Foreign Application Priority Data

Dec. 13, 2019 (JP) ..... JP2019-225293

(51) Int. Cl.
*G03G 9/087* (2006.01)
*G03G 9/08* (2006.01)
*G03G 9/097* (2006.01)

(52) U.S. Cl.
CPC ..... *G03G 9/08728* (2013.01); *G03G 9/0819* (2013.01); *G03G 9/0825* (2013.01); *G03G 9/08731* (2013.01); *G03G 9/08755* (2013.01); *G03G 9/09775* (2013.01)

(58) Field of Classification Search
CPC ..... G03G 9/08728; G03G 9/0819; G03G 9/0825; G03G 9/08731; G03G 9/08755; G03G 9/09775
See application file for complete search history.

(56) References Cited

U.S. PATENT DOCUMENTS 6,430,384 B2 8/2002 Hama et al.
7,135,263 B2 11/2006 Kawakami et al.
8,084,174 B2 12/2011 Hasegawa et al.
8,323,726 B2 12/2012 Naka et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,152,088 B1 10/2015 Kobori et al.
9,348,247 B2 5/2016 Ida et al.
9,348,253 B2 5/2016 Kanno et al.
9,417,540 B2 8/2016 Hashimoto et al.
9,436,112 B2 9/2016 Iwasaki et al.
9,540,483 B2 1/2017 Ida et al.
9,575,426 B2 * 2/2017 Shimano ..... G03G 9/08795
9,651,883 B2 5/2017 Hama et al.
9,665,023 B2 5/2017 Kamae et al.
9,665,026 B2 5/2017 Iwasaki et al.
9,696,644 B2 7/2017 Ida et al.
9,897,934 B2 2/2018 Tamura et al.
9,915,885 B2 3/2018 Katsumata et al.
9,969,834 B2 5/2018 Ohtsu et al.
10,012,918 B2 7/2018 Ishigami et al.
10,012,920 B2 7/2018 Shibata et al.
10,012,921 B2 7/2018 Kamae et al.
10,036,970 B2 7/2018 Kanno et al.
10,078,281 B2 9/2018 Ida et al.
10,082,743 B2 9/2018 Hama et al.
10,088,765 B2 10/2018 Miyakai et al.
10,133,201 B2 11/2018 Kamae et al.
10,146,146 B2 12/2018 Komatsu et al.
10,175,595 B2 1/2019 Onozaki et al.
10,197,936 B2 2/2019 Onozaki et al.
10,203,619 B2 2/2019 Yamashita et al.
10,216,108 B2 2/2019 Iwasaki et al.
10,228,629 B2 3/2019 Tamura et al.
10,234,777 B2 3/2019 Ohtsu et al.
10,274,851 B2 4/2019 Hashimoto et al.
10,353,312 B2 7/2019 Kamae et al.
10,401,748 B2 9/2019 Hashimoto et al.
10,423,086 B2 9/2019 Hama et al.
10,423,090 B2 9/2019 Ohtsu et al.
(Continued)

FOREIGN PATENT DOCUMENTS

JP 2013097321 A 5/2013
JP 2017227766 A 12/2017
JP 2019078802 A 5/2019

OTHER PUBLICATIONS

U.S. Appl. No. 17/092,602, Kentaro Kamae, filed Nov. 9, 2020.
U.S. Appl. No. 17/116,402, Takeshi Hashimoto, filed Dec. 9, 2020.
U.S. Appl. No. 17/117,444, Ichiro Kanno, filed Dec. 10, 2020.
U.S. Appl. No. 17/117,883, Ichiro Kanno, filed Dec. 10, 2020.
U.S. Appl. No. 17/188,041, Takeshi Hashimoto, filed Mar. 1, 2021.
U.S. Appl. No. 17/189,794, Kentaro Kamae, filed Mar. 2, 2021.

*Primary Examiner* — Peter L Vajda
*Assistant Examiner* — Boone Alexander Evans
(74) *Attorney, Agent, or Firm* — Venable LLP

(57) ABSTRACT

A toner having: a toner particle containing a binder resin including a first resin that is a crystalline resin and a second resin that is an amorphous resin; and a fine particle on a surface of the toner particle, wherein the first resin contains a specific ratio of a specific monomer unit, an acid value of the first resin and an acid value of the second resin arc within specific ranges, a domain-matrix structure formed of a matrix containing the first resin and domains containing the second resin appears in cross -sectional observation of the toner, and the fine particle has on the surface a compound containing nitrogen atoms bound or adsorbed thereon.

12 Claims, No Drawings

(56) References Cited

U.S. PATENT DOCUMENTS

| | | | | |
|---|---|---|---|---|
| 10,451,986 | B2 | 10/2019 | Sano et al. | |
| 10,451,990 | B2 | 10/2019 | Kamae et al. | |
| 10,474,049 | B2 | 11/2019 | Onozaki et al. | |
| 10,514,624 | B2 | 12/2019 | Tamura et al. | |
| 10,564,560 | B2 | 2/2020 | Onozaki et al. | |
| 10,599,060 | B2 | 3/2020 | Kanno et al. | |
| 10,656,545 | B2 | 5/2020 | Kamae et al. | |
| 10,775,710 | B1 | 9/2020 | Kamae et al. | |
| 2003/0165759 | A1* | 9/2003 | Suzuki | G03G 9/08737 430/108.4 |
| 2013/0108955 | A1 | 5/2013 | Shibata et al. | |
| 2013/0288173 | A1 | 10/2013 | Hashimoto et al. | |
| 2014/0134535 | A1 | 5/2014 | Baba et al. | |
| 2014/0329176 | A1 | 11/2014 | Kanno et al. | |
| 2015/0099227 | A1 | 4/2015 | Ida et al. | |
| 2018/0275540 | A1 | 9/2018 | Matsuo et al. | |
| 2018/0314176 | A1 | 11/2018 | Ikeda et al. | |
| 2019/0384193 | A1 | 12/2019 | Hashimoto et al. | |
| 2019/0384202 | A1 | 12/2019 | Shirayama et al. | |
| 2020/0057397 | A1 | 2/2020 | Murayama et al. | |
| 2020/0073263 | A1 | 3/2020 | Hama et al. | |
| 2020/0166862 | A1 | 5/2020 | Onozaki et al. | |
| 2020/0183295 | A1 | 6/2020 | Kanno et al. | |
| 2020/0272068 | A1 | 8/2020 | Ochi et al. | |
| 2020/0301301 | A1 | 9/2020 | Chimoto et al. | |

* cited by examiner

TONER

BACKGROUND OF THE INVENTION

Field of the Invention

The present disclosure relates to a toner far use in electrophotographic systems, electrostatic recording systems, electrostatic printing systems and toner jet systems.

Description of the Related Art

As electrophotographic full color copiers have proliferated in recent years, there has been increased demand for higher printer speeds and greater energy savings. To achieve high-speed printing, techniques have been studied for inciting the toner more rapidly in the fixing step. Techniques have also been studied for reducing the various control times within jobs and between jobs in order to increase productivity. As strategies for saving energy, techniques have been studied for fixing the toner at a lower temperature in order to reduce the energy expenditure in the fixing step.

Methods for achieving high-speed printing while improving the low -temperature fixability of the toner including lowering the glass transition temperature or softening point of the binder resin in the toner, and using a binder resin having a sharp -melt property. In recent years, many toners have been proposed that contain crystalline polyesters as resins having sharp-melt properties. However, crystalline polyesters leave problems of charging stability in high-temperature, high-humidity environments, and particularly problems with maintaining charging performance after standing in high -temperature, high humidity environments.

Various toners have also been proposed that use crystalline vinyl resins as other crystalline resins having sharp-melt properties.

For example, Japanese Patent Application Publication No. 2013-097321 proposes a toner with which both low-temperature fixability and heat-resistant storage stability are achieved by using an acrylate resin having crystallinity in the side chains.

Japanese Patent Application Publication No. 2017-227766 proposes a toner using a binder resin including an amorphous vinyl resin chemically linked to a crystalline vinyl resin.

As another approach to the technical problem of charge retention, there has been a proposal for improving the charging performance through improved external particle addition techniques, or through formation of a shell on the surface of the toner particle.

For example, Japanese Patent Application Publication No. 2019-078802 proposes a toner with which the charging stability of a toner is improved by binding an external additive particle to the binder resin of a toner.

SUMMARY OF THE INVENTION

Using the techniques of the above patent documents, it is possible to achieve both low-temperature fixability and heat-resistant storage stability, and there has also been some improvement in charging stability, i.e., a weak point of toners using crystalline polyester resins. However, it has been found that such toners using crystalline vinyl resins as binder resins have slow rise-up of charging, and there is still significant room for improvement in terms of stable, high-quality image formation.

In particular, it has been found that when an image with a small print percentage is printed and then the image is allowed to stand for a long period, and thereafter image output is restarted, bias occurs in the charge density within the toner particle surface, and the micro image quality of dots and thin lines and the like is likely to suffer as a result. To solve this problem, there is still a need for research into further technical developments aimed at achieving rapid and uniform triboelectric charging on the toner particle surface.

The present disclosure provides a toner that achieves both low-temperature fixability and heat-resistant storage stability while also yielding high-quality images and providing charging stability under various conditions of use.

At least one embodiment of the present disclosure provides a toner comprising:

a toner particle containing a binder resin including a first resin and a second resin; and a fine particle on a surface of the toner particle, wherein the first resin is a crystalline resin, the second resin is an amorphous resin, the first resin contains a first monomer unit represented by formula (1) below, a content ratio of the first monomer unit in the first resin is 300 mass % to 99.9 mass %, an acid value of the first resin is 0.1 mg KOH/g to 30.0 mg KOH/g, an acid value of the second resin is 0.5 mg KOH/g to 40.0 mg KOH/g, a domain matrix structure formed of a matrix containing the first resin and domains containing the second resin appears in cross-sectional observation of the toner, and the fine particle has on the surface a compound containing nitrogen atoms bound or adsorbed thereon:

in formula (1), $R_{Z1}$ represents a hydrogen atom or a methyl group, and R represents a $C_{18-36}$ alkyl group.

(1)

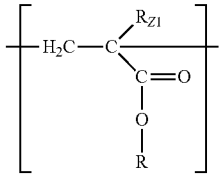

The present disclosure can provide a tones that achieves both low-temperature fixability and heat resistant storage stability while also yielding high-quality images and providing charging stability under various conditions of use.

Further features of the present invention will become apparent from the following description of exemplary embodiments.

DESCRIPTION OF THE EMBODIMENTS

Unless otherwise specified, descriptions of numerical ranges such as "from X to Y" or "X to Y" in the present disclosure include the numbers at the upper and lower limits of the range, In the present disclosure, a (meth)acrylic acid ester means an acrylic acid ester and/or a methacrylic acid ester.

When numerical ranges are described in stages, the upper and lower limits of each of each numerical range may be combined arbitrarily.

The term "monomer unit" describes a reacted form of a monomeric material in a polymer. For example, one carbon-carbon bonded section in a principal chain of polymerized vinyl monomers in a polymer is given as one unit. A vinyl monomer can be represented by the following formula (Z):

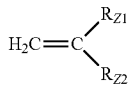

(Z)

[in formula (Z), $R_{Z1}$ represents a hydrogen atom or alkyl group (preferably a $C_{1-3}$ alkyl group, or more preferably a methyl group), and $R_{Z2}$ represents any substituent].

A crystalline resin is a resin exhibiting a clear endothermic peak in differential scanning calorimetry (DSC) measurement.

To address the issues of a binder resin containing a crystalline vinyl resin with excellent low-temperature fixability and heat-resistant storage stability, the inventors tested and evaluated a variety of resin characteristics and fine particle compositions on the toner particle surface, and discovered a toner material configuration that improves micro image quality. The inventors hypothesize that these effects are obtained by the following mechanisms.

The acid value of a binder resin in a toner particle is an indicator of the amount of acid sites having electron donating properties in the resin. Meanwhile, nitrogen (N) atoms in the fine particle have electron withdrawing properties. A fine particle having nitrogen (N) atoms has greater adhesiveness with a toner particle having a binder resin with an acid value on the surface of the particle, resulting in greater electrical and chemical stability. It is thought that this facilitates charge transfer between the charged fine particle and the toner particle surface, resulting in greater accumulation and diffusion of charge.

It is also thought that the adhesion of the fine particle to the toner particle becomes more uniform and the risk of adhesion bias caused by movement under mechanical load is reduced, making it easier to achieve a uniform distribution of charge on the toner particle surface.

Crystalline Resin

The first resin is a crystalline resin having a first monomer unit represented by formula (1).

The content ratio of the first monomer unit it he first resin is 30.0 mass % to 99.9 mass %. The acid value of the first resin is 0.1 mg KOH/g to 30 mg KOH/g. Because the first resin has such a first monomer unit, the binder resin has crystallinity and the low-temperature fixability of the toner is improved.

Low-temperature fixability and charging stability in low humidity environments are improved if the content ratio of the first monomer unit in the first resin is 30.0 mass % to 99.9 mass %.

If the content ratio of the first monomer unit is less than 30.0 mass %, low-temperature fixability declines. The range is more preferably 40.0 mass % to 85.0 mass %, or still more preferably 45.0 mass % to 75.0 mass %). If the content ratio of the first monomer unit exceeds 99.9 mass %, the charging stability of the toner surface charge in low humidity environments may be reduced because too much of the first resin is occupied by non-polar parts with low SP values.

The acid value of the first resin (crystalline resin) is 0.1 mg KOH/g to 30.0 mg KOH/g. If the acid value is within this range, the toner particle surface can more easily receive charge from the fine particle, and the charging stability of the toner improves.

If the acid value of the first resin is less than 0.1 mg KOH/g, the effect of improving the charging stability of the toner is not obtained because charge transfer from the fine particle to the toner particle surface does not occur smoothly. If the acid value of the first resin exceeds 30.0 mg KOH/g, charge retention may be reduced in high humidity environments in particular because the toner particle surface is less hydrophobic. A more preferred range is 5.0 mg KOH/g to 20.0 mg KOH/g;

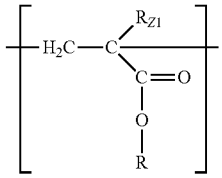

(1)

[In formula (1), $R_{Z1}$ represents a hydrogen atom or methyl group, and R represents a $C_{18-36}$ alkyl group (preferably a $C_{18-30}$ linear alkyl group).]

The first monomer unit represented by formula (1) is preferably a monomer unit derived from at least one selected from the group consisting of the (meth)acrylic acid esters having $C_{18-36}$ alkyl groups.

Examples of (meth)acrylic acid esters each having a $C_{18-36}$ alkyl group include (meth)acrylic acid esters each having a $C_{18-36}$ straight-chain alkyl group [stearyl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate, dotriacontyl (meth)acrylate, etc.] and (meth)acrylic acid esters each having a $C_{18-36}$ branched alkyl group [2-decyltetradecyl (meth)acrylate, etc.].

Of these, at least one selected from the (meth)acrylic acid esters having $C_{18-36}$ linear alkyl groups is preferred, at least one selected from the (meth)acrylic acid esters having $C_{18-30}$ linear alkyl groups is more preferred, and at least one selected from linear stearyl (meth)acrylate and behenyl (meth)acrylate is still more preferred from the standpoint of the low-temperature fixability and storage stability of the toner.

One kind of monomer alone or a combination of at least two kinds of monomers may be used to form the first monomer unit.

The first resin is preferably a vinyl polymer. The vinyl polymer may for example be a polymer of a monomer containing ethylenically unsaturated bonds. An ethylenically unsaturated bond is a radical polymerizable carbon-carbon double bond, and examples include vinyl, propenyl, acryloyl and methacryloyl groups and the like.

The first resin preferably has a second monomer unit that is different from the first monomer unit and is at least one selected from the group consisting of the monomer units represented by formula (2) below and the monomer units represented by formula (3) below.

When a second monomer unit is included, the linear alkyl sites of the first monomer unit are more likely to crystallize as blocks in the toner, and the fixing performance (sharp melt properties) is improved.

The content ratio of the second monomer unit in the first resin is preferably 1.0 mass % to 70.0 mass %, or more preferably 10.0 mass to 60.0 mass %, or still more preferably 15.0 mass % to 30.0 mass %.

(2)

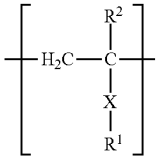

(3)

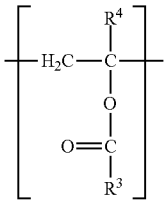

(In formula (2), X represents a single bond or $C_{1-6}$ alkylene group, $R^1$ represents a nitrile group (—C≡N), amido group (—C(═O)NHR$^{10}$ (in which $R^{10}$ represents a hydrogen atom or $C_{1-4}$ alkyl group)), hydroxy group, —COOR$^{11}$ (in which $R^{11}$ represents a $C_{1-6}$ (preferably $C_{1-4}$) alkyl group or $C_{1-6}$ (preferably $C_{1-4}$) hydroxy alkyl group).

urea group (—NH—C(═O)—N($R^{13}$)$_2$ (in which of two $R^{13}$s independently represents a hydrogen atom or $C_{1-6}$ (preferably $C_{1-4}$) alkyl group)), —COO($CH_2$)$_2$ NHCOOR$^{14}$ (in which $R^{14}$ represents a $C_{1-4}$ alkyl group) or —COO($CH_2$)$_2$ —NH—C(═O)—N($R^{15}$)$_2$ (in which of two $R^{15}$s independently represents a hydrogen atom or $C_{1-6}$ (preferably $C_{1-4}$) alkyl group), and $R^2$ represents a hydrogen atom or methyl group.)

(In formula (3), $R^3$ represents a $C_{1-4}$ alkyl group and $R^4$ represents a hydrogen atom or methyl group.)

The content the first resin (crystalline resin) in the binder resin is preferably at least 30.0 mass %.

Within this range, both low-temperature fixability and hot offset resistance can be achieved because it is easy to form a domain-matrix structure comprised of a matrix containing the first resin and domains containing the second resin. The content is more preferably at least 50.0 mass %, or still more preferably at least 55.0 mass %.

There is no particular upper limit, but preferably it is not more than 97.0 mass %, or more preferably not more than 75.0 mass %.

To more easily obtain these effects, the content of the second resin (amorphous resin) in the binder resin is preferably at least 3.0 mass %, or more preferably at least 10.0 mass %, or still more preferably at least 20.0 mass %, or yet more preferably at least 30.0 mass %. The upper limit thereof is preferably not more than 70.0 mass %, or more preferably not more than 50.0 mass %, or still more preferably not more than 45.0 mass %.

Amorphous Resin

One feature is that the acid value of the amorphous resin (second resin) is 0.5 mg KOH/g to 40.0 mg KOH/g. Within this range, the second resin interacts with the first resin, charge diffuses easily from the externally added fine particle to the entire toner particle surface, and uniform charging becomes easier because the charge density of the toner surface is reduced.

If the acid value of the second resin is less than 0.5 mg KOH/g, the effect of interaction with the first resin is not obtained, and the effect of improving the charge uniformity of the toner is hard to achieve because charge transfer does not occur smoothly. If the acid value of the second resin exceeds 40.0 mg KOH/g, charge retention may be reduced under high humidity conditions in particular because the hydrophobicity of the toner particle surface is reduced. A more preferred range is 1 mg KOH/g to 30.0 mg KOH/g, or more preferably from 3.0 mg KOH/g to 20.0 mg KOH/g.

Examples of the second resin include the following, resins: monopolymers of styrenes and substituted styrenes, such as polystyrene, poly-p-chlorostyrene and polyvinyl toluene; styrene copolymers such as styrene-p-chlorostyrene copolymer, styrene-vinyl toluene copolymer, styrene-vinyl naphthaline copolymer, styrene-acrylic acid ester copolymers, styrene-methacrylic acid ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylem resin, polyvinyl butyral, terpene resin, coumarone-indene resin and petroluem-based resins.

Of these, from the standpoint of the dime stability the second resin is preferably at least one selected from the group consisting of the vinyl resins (such as styrene copolymers), polyester resins, and hybrid resins comprising vinyl resins linked to polyester resins. Linked here may mean linked by covalent bonds. The second resin more preferably contains a polyester resin, and still more preferably is a polyester resin.

The second resin is explained below using the example of a polyester resin.

The polyester resin is preferably a condensation polymer of an alcohol component and a carboxylic acid component.

The acid value of the second resin can be controlled for example by varying the contents and types of the alcohol units and carboxylic acid units in the amorphous resin.

An alcohol unit in the second resin is a structure obtained by condensation polymerization of a monomer that is an alcohol component, or in other words is a monomer unit derived from an alcohol component. Moreover, a carboxylic acid unit in the second resin is a structure obtained by condensation polymerization of a monomer that is a carboxylic acid component, or in other words is a monomer unit derived from a carboxylic acid component.

From the standpoint of the charge stability, a structure obtained by condensation polymerization of a bisphenol A alkylene oxide adduct preferably constitutes at least 75 mol %, or more preferably at least 80 mol %, or still more preferably at least 90 mol % of the alcohol units. An example of a bisphenol A alkylene oxide adduct is a compound represented by formula (A) below:

(A)

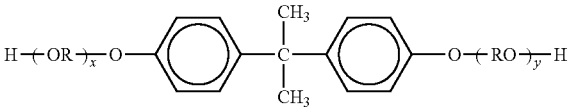

(in tbrmula (A), each R is independently an ethylene or propylene group, each of x and y is 0 or an integer of at least 0, and the average value of x+y is from 0 to 10).

Considering, the charge stability, the bisphenol A alkylene oxide adduct is preferably a bisphenol A propylene oxide adduct and/or ethylene oxide adduct, and more preferably is a propylene oxide adduct. The average value of x+y is preferably from 1 to 5, and more preferably from 1.6 to 2.8.

The following polyhydric alcohol components may he used as components other than the bisphenol A alkylene oxide adduct for forming the alcohol units:

ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,4,5-pentanetriol, glycerin, 2-methylpropantriol, 2-methyl-1,2,4-butanetriol, trimethylol ethane, trimethylol propane, 1,3,5-trihydroxymethyl benzene.

From the standpoint of low-temperature fixability and hot offset resistance, the peak molecular weight Mp of the second resin is preferably 3000 to 30000, or more preferably 5000 to 20000, or still more preferably 10000 to 15000.

The carboxylic acid units preferably include at least one selected from the group consisting of the aromatic dicarboxylic acid polycondensation structures, saturated aliphatic dicarboxylic acid polycondensation structures and unsaturated dicarboxylic acid polycondensation structures.

Examples of aromatic dicarboxylic acids include phthalic acid, isophthalic acid and terephthalic acid, and their anhydrides.

Alkyldicarboxylic acids such as oxalic acid, malonic acid, succinic acid, adipic acid, suberic acid, azelaic acid and sebacic acid and their anhydrides are desirable as saturated aliphatic dicarboxylic acids from the standpoint of charge stability.

Unsaturated dicarboxylic acids such as fumaric acid, maleic acid, citraconic acid, itaconic acid and succinic acid substituted with $C_{6-18}$ alkenyl groups, and anhydrides of these, are desirable as unsaturated dicarboxylic acids. It is especially desirable to include dodecenylsuccinic acid. It is note desirable to combine at least two of the above saturated aliphatic dicarboxylic acids and unsaturated dicarboxylic acids.

Considering the change stability and hot offset resistance, the carboxylic acid units preferably include a polycondensation structure of an aromatic tricarboxylic acid or aromatic tetracarboxylic acid.

Examples of the aromatic tricarboxylic acid include trimellitic acid and trimellitic anhydride. Examples of aromatic tetracarboxylic acids include pyromellitic acid and pyromellitic anhydride.

A polycondensation structure of an aromatic carboxylic acid preferably constitutes 30 mol % to 90 mol %, or more preferably 40 mol % to 80 mol %, of the carboxylic acid units.

Increasing the content ratio of aromatic carboxylic acids relative to aliphatic dicarboxylic acids is desirable for improving charge retention.

Examples of aromatic carboxylic acids include the aforementioned aromatic dicarboxylic acids, aromatic tricarboxylic acids and aromatic tetracarboxylic acids.

Other carboxylic acids for forming the carboxylic acid units include succinic acid or its anhydride substituted with $C_{6-18}$ alkyl groups, and polyvalent carboxylic acids such as 1,2,3,4-butanetetracarboxylic acid and benzophenonetetracarboxylic acid and their anhydrides.

The amorphous polyester resin can be manufactured using any commonly used catalysts, including metals such as tin, titanium, antimony, manganese, nickel, zinc, lead, iron, magnesium, calcium and germanium and compounds containing these metals.

Of these, a tin compound is desirable for improving charging performance. Examples of tin compounds include organic tin compounds such as dibutyl tin dichloride, dibutyl tin oxide, diphenyl tin oxide and the like. An organic tin compound here is a compound having Sn—C bonds.

An inorganic tin compound having no Sn—C bonds can also be used favorably. An inorganic tin compound here is a compound having no Sn—C bonds, Examples of inorganic tin compounds include non-branched tin alkylcarboxylates such as tin diacetate, tin dihexanoate, tin dioctanoate and tin distearate, branched tin alkylcarboxylates such as tin dineopentylate and tin di(2-ethylhexanoate), tin carboxylates such as tin oxalate, and dialkoxytins such as dioctyloxytin and distearoxytin.

Of these tin compounds, a tin alkylcarboxylate or dialkoxytin is preferred, and tin dioctanoate, tin di(2-ethylhexanoate) and tin distearate which are tin alkylcarboxylates having carboxyl residues in the molecule, are especially desirable.

The inventors' research has shorn that when using a crystalline vinyl resin as the principal component of a binder resin, adding an amorphous resin to confer viscoelasticity in high-temperature regions does not necessarily result in a wider fixing temperature range. In fact, it has been found that both low-temperature fixability and hot offset resistance are reduced in some cases.

Further investigation revealed a correlation between the fixing temperature range and a domain-matrix structure composed of a matrix containing a crystalline resin and domains containing an amorphous resin in the toner cross-section.

The inventors believe that the effects of the domain-matrix structure are achieved by means of the following mechanism. In a domain-matrix structure in the toner cross-section, excellent low-temperature fixability is obtained if the matrix contains a crystalline resin as a first resin.

If the toner particle has a uniform structure in which the crystalline resin and amorphous resin are blended together rather than forming a domain-matrix structure, low-temperature fixability is reduced because the sharp melt properties of the crystalline resin are lost.

If the toner has a domain-matrix structure composed of a matrix of an amorphous resin and domains of a crystalline resin, on the other hand, the sharp melt properties of the crystalline resin are not fully obtained and low-temperature fixability is reduced because the melting properties are dominated by the amorphous resin.

Preferably the matrix is exposed on at least part of the toner particle surface, and at least some of the fine particles are in contact with the exposed part of the matrix.

From the standpoint of low-temperature fixability and hot offset resistance, the number-average diameter of the domains in cross-sectional observation of the toner is preferably 0.10 μm to 2.00 μm, or more preferably 0.50 μm to 1.50 μm, If the number-average diameter of the domains is not more than 2.00 μm, the amorphous resin of the domains melts easily in the toner particle during fixing, resulting in good fixing performance. Hot offset can also be controlling in high-temperature regions because the viscosity of the melted crystalline resin of the matrix can be maintained at an appropriate level.

If the number-average diameter of the domains is at least 0.10 μm, low -temperature fixability is improved because the sharp-melt properties of the crystalline resin are easily obtained.

The number-average diameter of the domains can be controlled by controlling the monomer compositions of the crystalline resin and the amorphous resin, the manufacturing conditions and the like.

Linking Crystalline Resin and Amorphous Resin

The binder resin preferably contains a third resin. The third resin preferably contains a resin comprising the first resin (crystal resin) linked to the second resin (amorphous resin), and more preferably is a resin comprising the first resin linked to the second resin. Good charge stability, low-temperature fixability and hot offset resistance are obtained when such a third resin is included. The third resin preferably has a structure in which at least parts of the first resin and second resin are linked together for example.

Methods of linking the first resin to the second resin include methods of crosslinking by applying a radical initiator to a mixture obtained by melting or fusing the first resin and second resin, and methods of crosslinking using a crosslinking agent having a functional group that reacts with both the first resin and the second resin and the like.

The radical initiator used in the methods of crosslinking using a radical initiator is not particularly limited, and may be an inorganic peroxide, organic peroxide, azo compound or the like. These radical reaction initiators may also be combined.

When both the first resin and the second resin have carbon-carbon unsaturated bonds, these bonds are cleaved when the first resin and second resin are crosslinked. When either or both of the first resin and second resin have no carbon-carbon unsaturated bonds, the two are crosslinked by extracting hydrogen atoms bonded to carbon atoms contained in the first resin and/or second resin. In this case, the radical initiator is more preferably an organic peroxide having strong hydrogen extraction ability.

The crosslinking agent having a functional group that reacts with both the first resin and the second resin is not particularly limited, and a known agent may be used, such as a crosslinking agent having an epoxy group, a crosslinking agent having an isocyanate groups, a crosslinking agent having an oxazoline group, a crosslinking agent having a carbodiimide group, a crosslinking agent having a hydrazide group, a crosslinking agent having an aziridine group or the like.

In methods of crosslinking using a crosslinking agent having a functional group that reacts with both the first resin and the second resin, both the first and second resin must have functional groups that react with the crosslinking agent.

A resin in which at least parts of the first resin and second resin crosslinked by the above method are linked together (that is, a resin composition containing the first resin and the second resin, and a third resin obtained by crosslinking the first and second resin) may be used to manufacture a toner.

When the toner is manufactured by a melt kneading method, a toner p e containing a resin comprising the first resin linked to the second resin can be manufactured by melt kneading a raw material mixture containing the first and second resin in the presence of the above radical initiator or crosslinking agent.

The content of the third resin in the binder resin is preferably 1.0 mass % to 20.0 mass %, or more preferably from 5.0 mass % to 15.0 mass %.

For example, the third resin is preferably a resin obtained by adding a radical reaction initiator while melt kneading an amorphous polyester resin having carbon -carbon double bonds (second resin) with the first resin to thereby perform a crosslinking reaction.

When the third resin is manufactured using the first resin and second resin, at least parts of the first resin and second resin link together to form the third resin. This yields a binder resin containing the first resin, the second resin and the third resin.

A binder resin containing the first resin, the second resin and the third resin can also be obtained by linking at least parts of the first resin and second resin. The binder resin can also be obtained by manufacturing the third resin separately and then mixing with the first resin and second resin.

The radical reaction initiator used for this crosslinking reaction is not particularly limited, and may be an inorganic peroxide, organic peroxide, azo compound or the like. These radical reaction initiators may also be combined.

The inorganic peroxide is not particularly limited, and examples include hydrogen peroxide, ammonium peroxide, potassium peroxide, sodium peroxide and the like.

The organic peroxide is not particularly limited, and examples include benzoyl peroxide, di-t-butyl peroxide, t-butylcumyl peroxide, dicumyl peroxide, α,α-bis(t -butylperoxy)diisopropyl benzene, 2,5-dimethyl-2,5-bis(t-butylperoxy) hexane, di-t -hexyl peroxide, 2,5-dimethyl-2,5-di-t-butylperoxyhexine-3, acetyl peroxide, isobutyryl peroxide, octanoyl peroxide, decanoyl peroxide, lauroyl peroxide, 3,3,5-trimethylhexanoyl peroxide, m-toluyl peroxide, t-butyl peroxyisobutyrate, t-butyl peroxyneodecanoate, cumyl peroxyneodecanoate, t-butyl peroxy-2-ethylhexanoate, t -butylperoxy-3,5,5-trimethylhexanoate, t-butyl peroxylaurate, t-butyl peroxybenzoate, t -butyl peroxyisopropyl monocarbonate, t-butyl peroxyacetate and the like.

The azo compound or diazo compound is not particularly limited, and examples include 2,2'-azobis-(2,4-dimethylvaleronitrile), 2,2'-azobisisobutyronitrile, 1,1'-azobis(cyclohexan-1-carbonitrile), 2,2,'-azobis-4-methoxy-2,4-dimethylvaleronitrile, azobisisobutyronitrile and the like.

Of these, an organic peroxide is desirable because it has high initiator efficiency and does not produce toxic byproducts such as cyan compounds.

A reaction initiator with high hydrogen extraction ability is desirable because the crosslinking reaction can proceed efficiency with a smaller amount of the initiator, and a radical reaction initiator with high hydrogen extraction ability such as t -butylperoxyisopropyl monocarbonate, benzoyl peroxide, di-t-butyl peroxide, t -butylcumyl peroxide, dicumyl peroxide, α,α-bis(t-bulylperoxy)diisopropyl benzene, 2,5-dimethyl-2,5-bis(t-butylperoxy) hexane or di-t-hexylperoxide is even more desirable.

The amount of the radical reaction initiator used is not particularly limited, but is preferably 0.1 to 50 mass parts, or more preferably 0.2 to 5 mass parts per 100 mass parts of the binder resin to be crosslinked.

From the standpoint of low-temperature fixability, hot offset resistance and charging stability, the mass ratio Y/X of the content Y of the second resin to the content X of the first resin in the binder resin is preferably 0.20 to 2.00, or more preferably 0.30 to 1.50.

Fine Particle

The toner has a fine particle on the toner particle surface. The fine particle has a compound containing nitrogen atoms bound or adsorbed to the surface thereof. The fine particle having the bound or adsorbed compound containing nitrogen atoms preferably exists as an externally added fine particle on the toner particle surface, and more preferably exists as an externally added fine particle that is uniformly attached to the toner particle surface.

The number-average diameter of the fine particle is preferably 1/1000 to 1/20 times the number-average diameter of the toner.

Inorganic fine particles such as silica fine particles and metal oxide fine particles (alumina fine particles, titanium oxide fine particles, magnesium oxide fine particles, zinc oxide fine particles, strontium titanate fine particles, barium titanate fine particles, etc.) may be used for the fine particle.

Organic fine particles of vinyl resin, silicone resin, melamine resin and the like and organic-inorganic composite particles and the like may also be used. An inorganic fine particle is preferred, and a silica fine particle is more preferred.

The content of the fine particle having a bound or adsorbed compound containing nitrogen atoms is preferably 0.1 to 4.0 mass parts, or more preferably 0.2 to 3.5 mass parts, or still more preferably 1.0 to 3.0 mass parts per 100.0 mass parts of the toner particle.

The fine particle having a bound or adsorbed compound containing nitrogen atoms is preferably such an inorganic fine particle, organic fine particle or organic -inorganic composite particle that has been surface treated with a compound containing nitrogen atoms.

The compound containing nitrogen atoms is preferably a compound having an amino group or quaternary ammonium group as a substituent having nitrogen atoms. That is, the compound containing nitrogen atoms preferably includes at least one selected from the group consisting of the compounds having amino groups and the compounds having quaternary ammonium groups, and more preferably is at least one selected from the compounds having amino groups and the compounds having quaternary ammonium groups.

An amino group-containing silane coupling agent or an amino-modified silicone oil having an amino group introduced terminally or in the side chains may be used as a compound having an amino group. Of these, an amino group-containing silane coupling agent is especially desirable for imparting toner flowability.

Examples of amino group-containing silane coupling agents include N -2(aminoethyl) 3-aminopropyl methyldimethoxysilane, N-2(aminoethyl) 3-aminopropyl trimethoxysilane, 3-aminopropyl trimethoxysilane, 3-aminopropyl triethoxysilane, N -phenyl-3-aminopropyl triethoxysilane and the like.

Of these, 3-aminopropyl triethoxysilane is especially desirable because it has an excellent improving effect on charging performance and environmental stability.

Examples of compounds having quaternary ammonium groups include quaternary ammonium salts. The quaternary ammonium salts are not particularly limited, but examples include known materials including tetraalkyl ammonium salts such as octadecyl trimethylammonium chloride, trialkylallyl ammonium salts, dialkyldiaryl ammonium salts, alkyltriaryl ammonium salts, tetraaryl ammonium salts, cyclic ammonium salts, dicyclic ammonium salts, quaternary ammonium salt-type silanes and the like.

The method of treating the fine particle surface with the quaternary ammonium salt may for example be a method of dissolving the quaternary ammonium salt in a suitable solvent, adding it to coat the surface of the fine particle, and then drying the solvent. A kneader coater, spray dryer, thermal processor, fluidized bed or the like may be used for this treatment. Pulverization and classification may also be performed as necessary. Dry treatment with a Nobilta or the like is also possible.

Surface treatment with the quaternary an salt may also be performed for example by first dissolving the quaternary ammonium salt in ethyl alcohol, stirring and mixing it with the fine particle, and then vacuum drying to remove the ethyl alcohol solvent, leaving the quaternary ammonium salt on the fine particle surface.

The surface treatment amount of the compound having nitrogen atoms is preferably 0.02 to 15 mass parts, or more preferably 0.05 to 10 mass parts, or still more preferably 0.1 to 8 mass parts per 100 mass parts of the fine particle.

If the fine particle to be treated is a silica fine particle and the treatment agent is an amino group-containing silane coupling agent, the OH groups on the surface of the silica fine particle react with the coupling agent, and in this case the compound containing nitrogen atoms becomes bound to the surface of the fine particle. On the other hand, if the fine particle to be treated is a strontium titanate fine particle and the treatment agent is an amino group-containing silane coupling agent, or if the fine particle to be treated is a silica fine particle and the treatment agent is an amino group -containing silicone oil, no reaction occurs between the fine particle and the treatment agent, and in such cases the compound containing nitrogen atoms is instead adsorbed onto the surface of the fine particle.

That is, when the fine particle to be treated and the treatment agent react based on the combination thereof and the treatment conditions, the result is that the compound containing nitrogen atoms becomes bound to the fine particle, while when they do not react, the result is that the compound containing nitrogen atoms is adsorbed onto the fine particle.

It is desirable to surface treat the fine particle with a compound containing an alkyl group in addition to the compound containing nitrogen atoms in order to improve the hydrophobicity of the fine particle and suppress differences in the charge quantity due to humidity. That is, the fine particle preferably has a compound having an alkyl group at least on the surface of the particle. Moreover, the fine particle is preferably a particle that has been surface treated with a compound containing nitrogen atoms and a compound having an alkyl group.

In particular, including a silicon compound containing an alkyl group but no nitrogen atoms as a surface treatment agent not only makes it easier to control the polarity of positive to negative charges, but also facilitates triboelectric charging through contact between fine particles, so that the charge distribution tends to be more uniform on the toner surface, and the electrostatic attachment force on the contact surfaces can be reduced.

Examples of compounds having alkyl groups include fatty acids, fatty acid metal salts, silicone oils, silane coupling agents, titanium coupling agents and fatty alcohols.

Of these, at least one compound selected from the group consisting of the fatty acids, fatty acid metal salts, silicone oils and silane coupling agents is preferred for easily obtaining the effects of the present disclosure.

Examples of fatty acids and fatty acid metal salts include lauric acid, stearic acid, behenic acid, lithium laurate, lithium stearate, sodium stearate, zinc laurate, zinc stearate, calcium stearate and aluminum stearate.

Examples of silicone oils include dimethyl silicone oil, methyl phenyl silicone oil, and alkyl modified silicone oils such as alpha-methylstyrene modified silicone oil and octyl modified silicone oil.

Examples of silane coupling agents include hexamethyl disilazane, trimethyl silane, trimethyl ethoxysilane, isobutyl trimethoxysilane, trimethyl chlorosilane, dimethyl dichlorosilane, methyl trichlorosilane, dimethyl ethoxysilane, dimethyl dimethoxysilane, octyl trimethoxysilane, decyl trimethoxysilane, cetyl trimethoxysilane and stearyl trimethoxysilane.

Examples of fatty alcohols include ethanol, n-propanol, 2-propanol, n-butanol, t-butanol, n-octanol, stearyl alcohol and 1-tetracosanol. The method of treatment with the fatty alcohol may be for example a method of treating the inorganic fine particle after heating and vaporizing at a temperature at or above the boiling point.

The compound having an alkyl group is preferably at least one compound selected from the group consisting of the compounds having $C_{4-24}$ (preferably $C_{4-18}$) alkyl groups. With such a compound, image quality retention is further improved because interactions with the alkyl groups of the first monomer unit are further improved.

Given Cx as the carbon number of the alkyl group represented by R in the first monomer unit and Cy as the carbon number of the alkyl group of the compound having an alkyl group, Cx/Cy is preferably 1.0 to 5.0, or more preferably 1.2 to 4.5 in order to further strengthen interactions between alkyl groups.

When using multiple first monomer units or multiple compounds having alkyl groups, the average carbon number based on the molar ratios is used.

A known technique may be used as the method of surface treatment, such as for example a method of mixing the fine particle and silicone oil with a mixer, a method of spraying the silicone oil onto the line particle with a sprayer, or a method of dissolving the silicone oil in a solvent and then mixing it with the fine particle. The method of treatment is not limited to these.

The number-average diameter of the primary particles of the fine particle is preferably 10 nm to 200 nm, or more preferably 20 nm to 50 nm. If the number-average diameter of the primary particles is within this range, the fine particle contacts and adheres more uniformly to the toner particle surface, resulting in good charge uniformity.

The first resin (crystalline resin) may also contain a third monomer unit different from the first monomer unit represented by formula (1) above and the second monomer unit represented by formula (2) or (3) above.

Polymerizable monomers capable of forming the third monomer unit include styrenes such as styrene and o-methylstyrene, and their derivatives, (meth)acrylic acid esters such as 2-ethylhexyl (meth)acrylate, and (meth)acrylic acid.

The first resin preferably contains a monomer unit derived from a styrene. The first resin also preferably contains a monomer unit derived from a (meth)acrylic acid.

The content ratio of the third monomer unit in the first resin is preferably 1.0 mass % to 20.0 mass %, or more preferably 5.0 mass % to 15.0 mass %.

Colorant

The toner may also use a colorant. Examples of colorants include the following.

Examples of black colorants include carbon black and blacks obtained by blending yellow, magenta and cyan colorants. A pigment may be used alone as a colorant, but combining a dye and a pigment to improve the sharpness is desirable from the standpoint of the image quality of full-color images.

Examples of pigments for magenta toners include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. pigment violet 19; and C.I. vat red 1, 2, 10, 13, 15, 23, 29 and 35.

Examples of dyes for magenta toners include C.I. solvent red 1, 3, 8, 23, 24, 25, 27, 30, 49, 81, 82, 83, 84, 100, 109 and 121; C.I. disper red 9; C.I. solvent violet 8, 13, 14, 21, 27; oil-soluble dyes such as C.I. disperse violet 1, and C.I. basic red 1, 2, 9, 12, 13, 14, 15, 17, 18, 22, 23, 24, 27, 29, 32, 34, 35, 36, 37, 38, 39 and 40; and basic dyes such as C.I. basic violet 1, 3, 7, 10, 14, 15, 21, 25, 26, 27 and 28.

Examples of pigments for cyan toners include C.I. pigment blue 2, 3, 15:2, 15:3, 15:4, 16, and 17; C.I. vat blue 6; and C.I, acid blue 45 and copper phthalocyanine pigments having 1 to 5 phthalimidomethyl substituents in the phthalocyanine framework.

Examples of dyes for cyan toners include C.I. solvent blue 70.

Examples of pigments for yellow toners include C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and vat yellow 1, 3 and 20.

Examples of dyes for yellow toners include C.I. solvent yellow 162.

The content of the colorant is preferably from 0.1 to 30 mass parts per 100 mass parts of the binder resin.

Wax

A wax may also be used in the toner. Examples of the wax include the following: hydrocarbon waxes such as microcrystalline wax, paraffin wax and Fischer -Tropsch wax; oxides of hydrocarbon waxes, as polyethylene oxide wax, and block copolymers of these; waxes such as carnauba wax consisting primarily of fatty acid esters; and waxes such as deoxidized carnauba wax consisting of partially or fully deoxidized fatty acid esters.

Other examples include the following: saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, ceryl alcohol and melissyl alcohol; fatty acid amides such as linoleamide, oleamide and lauramide; saturated fatty acid bisamides such as methylene bis stearamide, ethylene bis capramide, ethylene bis lauramide and hexamethylene bis stearamide; unsaturated fatty acid amides such as ethylene bis oleamide, hexamethylene bis oleamide, N,N'-dieoleyl adipamide and N,N'-dioleyl sebacamide; aromatic bisamides such as m-xylene bis stearamide and N,N'-distearyl isophthalamide; aliphatic metal salts (commonly called metal soaps) such as calcium stearate, calcium laurate, zinc stearate and magnesium stearate; waxes obtained by grafting vinyl monomers such as styrene and acrylic acid onto aliphatic hydrocarbon waxes; partial esterification products of polyhydric alcohols and fatty acids, such as behenic acid monoglyceride; and methyl ester compounds having hydroxy groups obtained by hydrogenation of plant-based oils and fats.

The content of the wax is preferably 2.0 to 30.0 mass parts per 100 mass parts of the binder resin.

Charge Control Agent

A charge control agent may also be included in the toner as necessary. A known charge control agent may be included in the toner, and a metal compound of an aromatic carboxylic acid is especially desirable because it is colorless and can provide a rapid charging speed and stably maintain a uniform charge quantity.

Examples of negative charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes. The charge control agent may be added either internally or externally to the toner particle.

The added amount of the charge control argent is preferably 0.2 to 10 mass part per 100 mass parts of the binder resin.

Other Fine Particle

Another fine particle may also be included in the toner in addition to the fine particle described above. The other fine particle may be added internally to the toner particle or mixed with the toner particle as an external additive.

The content of the other fine particle is preferably 0.1 mass parts to 2.0 mass parts or more preferably 0.2 mass parts to 1.5 mass parts per 100.0 mass parts of the toner particle.

The other fine particle may also be hydrophobized with a hydrophobic agent such as a silane compound, a silicone oil or a mixture of these.

Examples of the other fine particle include inorganic fine particles such as silica fine particles and metal oxide fine particles (alumina fine particles, titanium oxide fine particles, magnesium oxide fine particles, zinc oxide fine particles, strontium titanate fine particles, barium titanate fine particles, etc.).

An organic fine particle of vinyl resin, silicon resin, melamine resin or the like or an organic-inorganic composite particle or the like may also be used.

An inorganic fine powder with a specific surface area of from 50 $m^2/g$ to 400 $m^2/g$ is desirable as an external additive for improving flowability, while an inorganic fine powder with a specific surface area of from 10 $m^2/g$ to 50 $m^2/g$ is desirable for stabilizing durability. To both improve flowability and stabilize durability, fine particles with specific surface area within these ranges may be combined.

Developer

The toner may be used as a one-component developer, but from the standpoint of obtaining stable image quality in the long term, it is preferably mixed with a magnetic carrier and used as a two-component developer in order to improve dot reproducibility. That is, this is preferably a two-component developer containing a toner and a magnetic carrier, in which the toner is the toner of the present invention.

A common, well-known magnetic carrier may be used, and examples include surface oxidized iron powders, unoxidized iron powders, metal particles of iron, lithium, calcium, magnesium, nickel, copper, zinc, cobalt, manganese, chromium, rare earths and the like, alloy particles and oxide particles of these, magnetic bodies such as ferrite, and resin carriers with dispersed magnetic bodies (so-called resin carriers) comprising binder resins carrying these magnetic bodies in a dispersed state.

When the toner is mixed with a magnetic carrier and used as a two-component developer, good effects can normally be obtained if the carrier mixing ratio (toner concentration of the two-component developer) is from 2 mass % to 15 mass %, or more preferably from 4 mass % to 13 mass %.

Toner Particle Manufacturing Method

The method of manufacturing the toner particle is not particularly limited, and a conventional known manufacturing method such as a suspension polymerization method, emulsion aggregation method, melt kneading method or dissolution suspension method may be used.

A fine particle having a bound or adsorbed compound containing nitrogen atoms is externally added and mixed with the toner particle together with another fine particle as necessary to obtain a toner. The toner particle and fine particle may be mixed with a mixing apparatus such as a double cone mixer, V mixer, drum mixer, Super mixer, Henschel mixer, Nauta mixer, Mechano Hybrid (Nippon Coke & Engineering Co., Ltd.), Nobilta (Hosokawa Micron Corporation) or the like.

The methods for measuring the various physical properties of the toner and raw materials are explained below.

Number-Average Particle Diameter of Primary Particles of Fine Particle

The number-average particle diameter of the primary particles of the fine particle is measured using an S-4800 Hitachi ultra-high resolution field emission scanning electron microscope (FE-SEM) (Hitachi High-Technologies).

Measurement is performed on the toner after the fine particle has been mixed in.

With the magnification set to 50,000, photographs are taken and further enlarged two times, the maximum diameter (major axis diameter) "a" and minimum diameter (minor axis diameter) "b" of the fine particles are measured from the resulting FE-SEM photographs, and (a+b)/2 is regarded as the particle diameter of these particles. The diameters of 100 randomly selected fine particles are measured, and the average is calculated and regarded as the number-average diameter of the primary particles of the fine particle.

Method for Measuring Content Ratio of Each Monomer Unit in First Resin

The content ratio of each monomer unit in the first resin is measured by $^1$-NMR under the following conditions.

Measurement unit: FT NMR unit JNM-EX400 (JEOL Ltd.)

Measurement frequency: 400 MHz

Pulse condition: 5.0 μs

Frequency range: 10500 Hz

Number of integrations: 64

Measurement temperature: 30° C.

Sample: Prepared by placing 50 mg of the measurement sample in a sample tube with an inner diameter of 5 mm, adding deuterated chloroform ($CDCl_3$) as a solvent, and dissolving this in a thermostatic tank at 40° C., Of the peaks attributable to constituent elements of the first monomer unit in the resulting $^1$H-NMR chart, a peak independent of peaks attributable to constituent elements of otherwise-derived monomer units is selected, and the integrated value $S_1$ of this peak is calculated.

Similarly, a peak independent of peaks attributable to constituent elements of otherwise-derived monomer units is selected from the peaks attributable to constituent elements of the second monomer unit, and the integrated value $S_2$ of this peak is calculated.

When the first resin contains a third monomer unit, a peak independent of peaks attributable to constituent elements of otherwise-derived monomer units is selected from the peaks attributable to constituent elements of the third monomer unit, and the integrated value $S_3$ of this peak is calculated.

The content of the first monomer unit is determined as follows using the integrated values $S_1$, $S_2$ and $S_3$, $n_1$, $n_2$, and $n_3$ are the numbers of hydrogen atoms in the constituent elements to which the observed peaks arc attributed for each segment.

Content (mol %) of the first monomer unit=

$\{(S_1/n_1)/((S_1/n_1)+(S_2/n_2)+(S_3/n_3))\}\times 100$.

The second and third monomer units are determined similarly as shown below.

Content (mol %) of the second monomer unit=

$\{(S_2/n_2)/((S_1/n_1)+(S_2/n_2)+(S_3/n_3))\}\times 100$.

Content (mol%) of the third monomer unit=

$\{(S_3/n_3)/((S_1/n_1)+(S_2/n_2)+(S_3/n_3))\}\times 100$.

When a polymerizable monomer not containing a hydrogen atom in a constituent element other than a vinyl group is used in the first resin, measurement is performed in single pulse mode using $^{13}$C—NMR with $^{13}$C as the measurement nucleus, and the ratio is calculated in the same way as by $^{1}$H—NMR.

When the toner is manufactured by suspension polymerization, independent peaks may not be observed because the peaks of release agents and other resins overlap. It may thus be impossible to calculate the ratios of the monomer units derived from each of the polymerizable monomers in the first resin. In this case, a first resin' can be manufactured and analyzed as the first resin by performing similar suspension polymerization without using a release agent or other resin.

Method for Measuring Melting Points

The melting points of such as the resin is measured under the following conditions using a DSC Q1000 (TA Instruments).

Ramp rate: 10° C./min

Measurement start temperature: 20° C.

Measurement end temperature: 180° C.

The melting points of indium and zinc are used for temperature correction of the device detection part, and the heat of fusion of indium is used for correction of the calorific value.

Specifically, 5 mg of sample is weighed precisely into an aluminum pan, and subjected to differential scanning calorimetry. An empty silver pan is used for reference.

The peak temperature of the maximum endothermic peak during the first temperature rise is regarded as the melting point.

When multiple peaks are present, the maximum endothermic peak is the peak at which the endothermic quantity is the greatest.

Methods for Measuring Peak Molecular Weight and Weight-Average Molecular Weight of THF-Soluble Component of Resin by GPC The peak molecular weight and weight-average molecular weight (Mw) of the THF-soluble component of a resin such as the first resin or second resin are measured as follows by gel permeation chromatography (GPC).

First, the sample is dissolved in tetrahydrofuran (THF) over the course of 24 hours at room temperature. The resulting solution is filtered through a solvent-resistant membrane filter (Maishori Disk, Tosoh Corp.) having a pore diameter of 0.2 μm to obtain a sample solution. The concentration of THF-soluble components in the sample solution is adjusted to about 0.8 mass %. Measurement is performed under the following conditions using this sample solution.

System; HLC8120 GPC (detector: RI) (Tosoh Corp.)

Columns: Shodex KF-801, 802, 803, 804, 805, 806, 807 (total 7) (Showa Denko)

Eluent: Tetrahydrofuran (THF)

Flow rate: 1.0 mL/min

Oven temperature: 40.0° C.

Sample injection volume: 0.10 mL

A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Softening Point of Resin

The softening point of the resin is measured using a constant load extrusion type capillary rheometer (Shimadzu Corporation, CFT-500D Flowtester flow characteristics evaluation device) in accordance with the attached manual. With this device, the temperature of a measurement sample packed in a cylinder is raised to melt the sample while a fixed load is applied to the measurement sample from above with a piston, the melted measurement sample is extruded through a die at the bottom of the cylinder, and a flow curve can then be obtained showing the relationship between the temperature and the descent of the piston during this process.

In the present invention. the "melting temperature by ½ method" as described in the attached manual of the CFT-500D Flowtester flow characteristics evaluation device is given as the softening point.

The melting temperature by the ½ method is calculated as follows.

Half of the difference between the descent of the piston upon completion of outflow (outflow end point, given as "Smax") and the descent of piston at the beginning of outflow (minimum point, given as "Smin") is determined and given as X (X=(Smax−Smin)/2). The temperature in the flow curve at which the descent of the piston is the sum of X and Smin is the melting temperature by the ½ method.

For the measurement sample, about 1.0 g of resin is compression molded for about 60 seconds at about 10 MPa with a tablet molding compressor (such as NPa Systems Co., Ltd., NT-100H) in a 25° C. environment to obtain a cylindrical sample about 8 mm in diameter.

The specific operations for measurement are performed in accordance with the device manual.

The CFT-500D measurement conditions are as follows.

Test mode: Temperature increase method

Initial temperature: 50° C.

Achieved temperature: 200° C

Measurement interval: 1.0° C.

Ramp rate: 4.0° C./min

Piston cross sectional area: 1.000 $cm^2$

Test load (piston load): 10.0 kgf (0.9807 MPa)

Pre-heating time: 300 seconds

Die hole diameter: 1.0 mm

Die length: 1.0 mm

Measuring Glass Transition Temperature (Tg) of Resin

The glass transition temperature (Tg) is measured in accordance with ASTM D3418-82 using a differential scanning calorimeter (TA Instruments, Q2000), The melting points of indium and zinc are used for temperature correction of the device detection part, and the fusion heat of indium is used to correct the calorimetric value.

Specifically, 3 mg of sample is weighed exactly, placed in an aluminum pan, and measured under the following conditions using an empty aluminum pan for reference.

Ramp rate: 10° C./min

Measurement start temperature: 30° C.

Measurement end temperature: 180° C.

During measurement, the temperature is first raised to 180° C. and maintained for 10 minutes, then lowered to 30° C. at a rate of 10° C./min, and then raised again. A specific heat change is obtained in the temperature range of 30° C. to 100° C. during this second temperature rise. The glass transition temperature (Tg) is the point of intersection between the differential thermal curve and a line intermediate between baselines before and after the appearance of the specific heat change.

Method for Measuring Acid Value

The acid value is the number of mg of potassium hydroxide needed to neutralize the acid component contained in 1 g of sample. The acid value is measured as follows in accordance with JIS K 0070-1992.

(1) Reagent Preparation

A phenolphthalein solution is obtained by dissolving 1.0 g of phenolphthalein in 90 mL of ethyl alcohol (95 vol %) and adding ion-exchanged water to a total of 100 mL.

7 g of special-grade potassium hydroxide is dissolved in 5 mL of water, and this is brought to 1 L by addition of ethyl alcohol (95 vol %). This is placed in an alkali -resistant container while avoiding contact with carbon dioxide and the like, allowed to stand for 3 days, and filtered to obtain a potassium hydroxide solution. The resulting potassium hydroxide solution is stored in an alkali-resistant container. The factor of this potassium hydroxide solution is determined from the amount of the potassium hydroxide solution required for neutralization when 25 mL of 0.1 mol/L hydrochloric acid is placed in an Erlenmeyer flask, several drops of the phenolphthalein solution are added, and titration is performed with the potassium hydroxide solution. The 0.1 mol/L hydrochloric acid is prepared in accordance with JIS K 8001-1998.

(2) Operations (A) Main Test 2.0 g of a pulverized sample is weighed exactly into a 200 mL Erlenmeyer flask, 100 mL of a toluene:ethanol (2:1) mixed solution is added, and the sample is dissolved over the course of 5 hours. Several drops of the phenolphthalein solution are then added as an indicator, and titration is performed using the potassium hydroxide solution. The titration endpoint is taken to be persistence of the faint pink color of the indicator for 30 seconds.

(B) Blank Test

Titration is performed by the same procedures, but without using any sample (that is, with only the toluene:ethanol (2:1) mixed solution).

(3) The acid. value is calculated by substituting the obtained results into the following formula:

$$A=[(C-B)\times f\times 5.61]/S$$

where A is the acid value (mg KOH/g), B is the added amount (mL) of the potassium hydroxide solution in blank test, C is the added amount (mL) of the potassium hydroxide solution in main test, f is the factor of the potassium hydroxide solution, and S is the mass of the sample (g).

Weight-Average Particle Diameter (D4) of Toner Particle

Using a Multisizer (registered trademark) 3 Coulter Counter precise particle size distribution analyzer (Beckman Coulter, Inc.) based on the pore electrical resistance method and equipped with a 100 μm aperture tube, together with the accessory dedicated Beckman Coulter Multisizer 3 Version 3.51 software (Beckman Coulter, Inc.) for setting measurement conditions and analyzing measurement data, measurement is performed with 25000 effective measurement channels, and the measurement data are analyzed to calculate the weight-average particle diameter (D4) of the toner particle (or toner).

The aqueous electrolyte solution used in measurement may be a solution of special grade sodium chloride dissolved in ion-exchanged water to a concentration of about 1 mass %, such as ISOTON II (Beckman Coulter, Inc.) for example.

The dedicated software settings are performed as follows prior to measurement and analysis.

On the "Standard measurement method (SOM) changes" screen of the dedicated software, the total count number in control mode is set to 50000 particles, the number of measurements to 1, and the Kd value to a value obtained with "standard particles 10.0 μm" (Beckman Coulter, Inc.). The threshold noise level is set automatically by pushing the "Threshold/Noise Level measurement button". The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to from 2 μm to 60 μm.

The specific measurement methods are as follows.

(1) About 200 mL of the aqueous electrolyte solution is added to a dedicated 250 mL round-bottomed beaker of the Multisizer 3, the beaker is set on the sample stand, and stirring is performed with a stirrer rod counter-clockwise at a rate of 24 rotations/second. Contamination and bubbles in the aperture tube are then removed by the "Aperture tube flush" function of the dedicated software.

(2) 30 mL of the same aqueous electrolyte solution is placed in a glass 100 mL flat-bottomed beaker, and about 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries) diluted 3× by mass with ion-exchanged water is added.

(3) A specific amount of ion-exchanged water is placed in the water tank of an ultrasonic disperser (Ultrasonic Dispersion System Tetora 150, Nikkaki Bios) with an electrical output of 120 W equipped with two built-in oscillators having an oscillating frequency of 50 kHz with their phases shifted by 180° front each other, and about 2 mL of the Contaminon N is added to this water tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolyte solution in the beaker.

(5) The aqueous electrolyte solution in the beaker of (4) is exposed to ultrasound as about 10 mg of toner is added bit by bit to the aqueous electrolyte solution, and dispersed. Ultrasound dispersion is then continued for a further 60 seconds. During ultrasound dispersion, the water temperature in the tank is adjusted appropriately to from 10° C. to 40° C.

(6) The aqueous electrolyte solution of(5) with the toner dispersed therein is dripped with a pipette into the round-bottomed beaker of( )1 set on the sample stand, and adjusted to a measurement concentration of about 5%. Measurement is then performed until the number of measured particles reaches 50000.

(7) The measurement data is analyzed with the dedicated software attached to the apparatus, and the weight-average particle diameter (D4) is calculated. The weight -average particle diameter (D4) is the "Average diameter" on the "Analysis/volume statistical value (arithmetic mean)" screen when Graph/vol % is set in the dedicated software.

Methods for Observing Toner Cross-Section and Analyzing Matrix and Domains

Sections are first prepared as reference samples of abundance.

The first resin (crystalline resin) is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. A sample of the second resin (amorphous resin) is prepared in the same way.

The first resin and second resin are mixed at ratios of 0/100, 30/70, 70/30 and 0/100, and melt kneaded to prepare kneaded mixtures. These are similarly dispersed in visible light curable resin and cut to prepare sample sections.

Next, these reference samples are observed in cross-section by TEM-EDX using a transmission electron microscope (JEOL Ltd., JEM-2800 electron microscope), and element mapping is performed by EDX. The mapped elements are carbon, oxygen and nitrogen.

The mapping conditions are as follows.

Acceleration voltage: 200 kV
Electron beam exposure size: 1.5 nm
Live time limit: 600 sec
Dead time: 20 to 30
Mapping resolution: 256×256

(Oxygen element intensity/carbon element intensity) and (nitrogen element intensity/carbon element intensity) are calculated based on the spectral intensities of each element (average in 10 nm-square area), and calibration curves are prepared for the mass ratios of the first and second resin. When the monomer units of the first resin contain nitrogen, the subsequent assay is performed using the (nitrogen element intensity/carbon element intensity) calibration curve.

The toner samples are then analyzed.

The toner is first thoroughly dispersed in a visible light curable resin (Aronix LCR Series D800) and cured by exposure to short wavelength light. The resulting cured resin is cut with an ultramicrotome equipped with a diamond knife to prepare a 250 nm sample section. The cut sample is then observed by TEM-EDX using a transmission electron microscope (JEOL Ltd., JEM-2800 electron microscope). A cross-sectional image of the toner particle is obtained, and element mapping is performed by EDX. The mapped elements are carbon, oxygen and nitrogen.

Toner cross-sections for observation are selected as follows. The cross -sectional area of the toner is first determined from the cross-sectional image, and the diameter of a circle having the same area as the cross-sectional area (circle equivalent diameter) is determined. Observation is limited to toner cross-section images in which the absolute value of the difference between the circle equivalent diameter and the weight-average particle diameter (D4) is within 1.0 μm.

For the domains confirmed in the observed image, (oxygen element intensity/carbon element intensity) and/or (nitrogen element intensity/carbon element intensity) are calculated based on the spectrum intensities of each element (average of 10 nm square), and the ratios of the first and second resins are calculated based on a comparison with the calibration curves. A domain in which the ratio of the second resin is at least 80% is considered a domain in the present disclosure.

The domains confirmed in the observed image are specified and binarized to determine the particle diameter of the domains present in the toner cross-section. The particle diameter is given as the domain diameter. This is measured at 10 points in each toner, and the calculated average for the domains of 10 toners is given as the number -average diameter. Image Pro PLUS (Nippon Roper K. K.) is used for binarization.

Method for Separating Materials from Toner

Each of the materials contained in the toner can be separated from the toner using the differences among the materials in solubility in solvents.

First separation: The toner is dissolved in 23° C. methyl ethyl ketone (MEK), and the soluble component (second resin) is separated from the insoluble components (first resin, release agent, colorant, inorganic fine particle, etc.).

Second separation: The insoluble components obtained in the first separation (first resin, release agent, colorant, inorganic fine particle, etc.) are dissolved in 100° C. MEK, and the soluble components (first resin, release agent) are separated from the insoluble components (colorant, inorganic fine particle, etc.).

Third separation: The soluble components (first resin, release agent) obtained in the second separation are dissolved in 23° C. chloroform and separated into a soluble component (first resin) and an insoluble component (release agent).

When a Third Resin is Included

First separation: The toner is dissolved in 23° C. methyl ethyl ketone (MEK), and the soluble components (second resin, third resin) are separated from the insoluble components (first resin, release agent, colorant, inorganic fine particle, etc.).

Second separation: The soluble components (second resin, third resin) obtained in the first separation are dissolved in 23° C. toluene and separated into a soluble component (third resin) and an insoluble component (second resin).

Third separation: The insoluble components (first resin, release agent, colorant, inorganic fine particle, etc.) obtained in the first separation are dissolved in 100° C. MEK and separated into soluble components (first resin, release agent) and insoluble components (colorant, inorganic fine particle, etc.).

Fourth separation: The soluble components (first resin, release agent) obtained in the third separation are dissolved in 23° C. chloroform and separated into a soluble component (first resin) and an insoluble component (release agent).

Measuring Contents of First Resin and Second Resin in Binder Resin in Toner

The masses of the soluble components and insoluble components obtained in the separation steps above are measured to calculate the contents of the first resin and second resin in the binder resin in the toner.

EXAMPLES

The present invention is explained using the examples below. However, these do not in any way limit the present invention. Unless otherwise specified, parts in the formulations below are based on mass.

Manufacturing Example of Fine Particle 1

100 g of an untreated silica particle manufactured by flame hydrolysis with a number-average diameter of 30 nm of the primary particles were stirred in a small porcelain mortar crusher as 6 parts of 3-aminopropyl triethoxysilane were added per 100 parts of the silica particle. The silica particle was then stirred for 120 minutes with the mortar crusher.

The silica particle was then stirred with the mortar crusher as 12 parts of n -octyl triethoxysilane were added per 100 parts of the silica particle (parts before addition of the 3-aminopropyl triethoxysilane). The silica particle was then stirred for 120 minutes with the mortar crusher.

The coated silica particle that had been treated with the 3-aminopropyl triethoxysilane and n-octyl triethoxysilane was then heat treated for 72 hours at 85° C. with a drier. The heat-treated coated silica particle was then crushed to obtain a fine particle 1.

In the fine particle 1, the treatment agent (compound having nitrogen atoms) was bound to the fine particle.

Manufacturing Examples of Fine Particles 2 to 10

The untreated silica fine particle manufactured by the flame hydrolysis with a number-average diameter of 30 nm of the primary particles used in manufacturing the fine particle 1 was surface treated with the compounds shown in Table 1 to obtain fine particles 2 to 10. The added amount of the surface treatment agent was the same as for the fine particle 1.

The fine particle and the treatment agent (compound containing nitrogen atoms) are bound in the fine particles 2 to 9, and the fine particle adsorbed the treatment agent (compound containing nitrogen atoms) in the fine particle 10.

Manufacturing Examples of Fine Particles 11 and 12

Fine particles 11 and 12 were obtained by using hexamethylsilazane HMDS (10 parts) to hydrophobically treat untreated fine particles (100 parts) manufactured by flame hydrolysis with a number-average diameter of 30 nm or 12 nm of the primary particles.

The fine particles manufactured above are shown in Table 1.

Manufacturing Example of Crystalline Resin C1

Solvent: toluene 100.0 parts

Monomer composition 100.0 parts (the monomer composition is a mixture of behenyl acrylate, acrylonitrile, styrene and acrylic acid in the following proportions)

(Behenyl acrylate: 70.0 parts)

(Acrylonitrile: 18.7 parts)

(Styrene: 10.0 parts)

(Acrylic acid: 1.3 parts)

Polymerization initiator t-butyl peroxypivalate (NOF Corporation, Perbutyl PV) 0.5 parts These materials were placed in a reaction vessel equipped with a reflux condenser, a stirrer, a thermometer and a nitrogen introduction pipe in a nitrogen atmosphere. The contents of the vessel were stirred at 200 rpm while being heated to 70° C. and polymerized for 12 hours, to obtain a solution of a polymer of the monomer composition dissolved in toluene. This solution was then cooled to 25° C. and added under stirring to 1000.0 parts of methanol to precipitate a methanol-insoluble component. The resulting methanol-insoluble component was filtered out, further washed with methanol, and vacuum dried for 24 hours at 40° C. to obtain a crystalline resin C1. The crystalline resin C1 had a weight-average molecular weight of 73,000, a melting point of 64° C., and an acid value of 10.0 mg KOH/g.

Manufacturing Examples of Crystalline Resins C2 to C12

Crystalline resins C2 to C12 were obtained by changing the types and amounts of the materials as shown in Table 2 in the manufacturing method of the crystalline resin C1. The crystalline resins C2 to C12 exhibited clear endothermic peaks in DSC measurement.

TABLE 1

| Fine particle No. | Composition | Surface treatment Compound containing nitrogen atoms | Other surface treatment compound | Alkyl group carbon number of other compound | Number-average diameter (nm) of primary particles |
|---|---|---|---|---|---|
| 1 | Silica | 3-aminopropyl triethoxysilane | Octyl triethoxysilane | C8 | 30 |
| 2 | Silica | 3-aminopropyl triethoxysilane | Octyl modified silicone oil | C8 | 30 |
| 3 | Silica | 3-aminopropyl triethoxysilane | Stearic acid | C18 | 30 |
| 4 | Silica | 3-aminopropyl triethoxysilane | 1-tetracosanol | C24 | 30 |
| 5 | Silica | 3-aminopropyl triethoxysilane | Isobutyl trimethoxysilane | C4 | 30 |
| 6 | Silica | 3-aminopropyl triethoxysilane | n-propanol | C3 | 30 |
| 7 | Silica | 3-aminopropyl triethoxysilane | 1-octocosanol | C28 | 30 |
| 8 | Silica | 3-aminopropyl triethoxysilane | None | None | 30 |
| 9 | Silica | Octadecyl trimethyl ammonium chloride | None | None | 30 |
| 10 | Silica | Amino modified silicone oil (aminopropyl dimethicone) | None | None | 30 |
| 11 | Silica | None | HMDS | C1 | 30 |
| 12 | Silica | None | HMDS | C1 | 12 |

TABLE 2

| Crystalline resin No. | First monomer | Parts | F Mass % | Second monomer | Parts | Other monomer | Parts | Other monomer | Parts | Acid value |
|---|---|---|---|---|---|---|---|---|---|---|
| C1 | Behenyl acrylate (C22) | 70.0 | 70.0 | Acrylonitrile | 18.7 | Styrene | 10.0 | Acrylic acid | 1.3 | 10.0 |
| C2 | Stearyl acrylate (C18) | 70.0 | 70.0 | Acrylonitrile | 18.7 | Styrene | 10.0 | Acrylic acid | 1.3 | 10.0 |
| C3 | Lignoceryl acrylate (C24) | 70.0 | 70.0 | Acrylonitrile | 18.7 | Styrene | 10.0 | Acrylic acid | 1.3 | 10.0 |
| C4 | Behenyl acrylate (C22) | 70.0 | 70.0 | Acrylonitrile | 19.6 | Styrene | 10.0 | Acrylic acid | 0.4 | 3.0 |
| C5 | Behenyl acrylate (C22) | 70.0 | 70.0 | Acrylonitrile | 16.1 | Styrene | 10.0 | Acrylic acid | 3.9 | 30.0 |
| C6 | Behenyl acrylate (C22) | 30.0 | 30.0 | Acrylonitrile | 58.7 | Styrene | 10.0 | Acrylic acid | 1.3 | 10.0 |
| C7 | Behenyl acrylate (C22) | 85.0 | 85.0 | Acrylonitrile | 3.7 | Styrene | 10.0 | Acrylic acid | 1.3 | 10.0 |
| C8 | Behenyl acrylate (C22) | 20.0 | 20.0 | Acrylonitrile | 68.7 | Styrene | 10.0 | Acrylic acid | 1.3 | 10.0 |
| C9 | Behenyl acrylate (C22) | 2.0 | 2.0 | Acrylonitrile | 86.7 | Styrene | 10.0 | Acrylic acid | 1.3 | 10.0 |
| C10 | Behenyl acrylate (C22) | 70.0 | 70.0 | Acrylonitrile | 14.2 | Styrene | 10.0 | Acrylic acid | 5.8 | 45.0 |
| C11 | Palmityl acrylate (C16) | 70.0 | 70.0 | Acrylonitrile | 18.7 | Styrene | 10.0 | Acrylic acid | 1.3 | 10.0 |
| C12 | Behenyl acrylate (C22) | 60.0 | 70.0 | — | — | Styrene | 40.0 | — | — | 0.0 |

In the table, "F" represents the content ratio of the first monomer unit in the crystalline resin. The acid value is given in units of mg KOH/g.

Manufacturing Example of Amorphous Resin A1

Bisphenol A propylene oxide 2-mol adduct 1500 parts

Bisphenol A ethylene oxide 2-mol adduct 500 parts

Fumaric acid 250 parts

Terephthalic acid 350 parts

Acrylic acid 150 parts

Tin (II) dioctanoate 15 parts

These materials were placed in a 4-necked flask equipped with a stirring rod, a condenser and a nitrogen introduction pipe, and polymerized for 4.5 hours at 230° C. in a nitrogen atmosphere.

Once this had cooled to 160° C., 150 parts of trimellitic acid were added.

A mixture of 450 parts of styrene, 200 parts of 2-ethylhexyl acrylate and 30 parts of dicumyl peroxide as a polymerization initiator was then dripped in at 160° C. over the course of 2 hours. After completion of dripping, the temperature was raised to 200° C., and the mixture was reacted for 3 hours to obtain an amorphous resin A1 with a softening point of 115° C.

The resulting amorphous resin A1 had a peak molecular weight of 9000 according to GPC. The glass transition temperature was 60° C., and the acid value was 20.0 mg KOH/g.

Manufacturing Example of Amorphous Resin A2

Polyoxypropylene (2,2)-2,2-bis(4-hydroxphenyl) propane: 73.4 parts (0.186 moles; 100.0 mol % relative to total moles of polyhydric alcohol)

Terephthalic acid: 11.6 parts (0.070 moles; 45.0 mol % relative to total moles of polyvalent carboxylic acids)

Adipic acid: 6.8 parts (0.047 moles; 30.0 mol % relative to total moles of polyvalent carboxylic acids)

Tin di(2-ethylhexylate): 0.5 parts

These materials were weighed into a reaction tank equipped with a cooling pipe, a stirrer, a nitrogen introduction pipe and a thermocouple. The interior of the flask was purged with nitrogen gas, the temperature was raised gradually under stirring, and the mixture vas stirred at 200° C. while being reacted for 2 hours.

The pressure inside the reaction tank was then lowered to 8.3 kPa and maintained for 1 hour, after which the temperature was lowered to 180° C. and the pressure was returned to atmospheric pressure (first reaction step).

Trimellitic anhydride: 8.2 parts (0.039 moles; 25.0 mol % relative to total moles of polyvalent carboxylic acids)

Tert-butyl catechol (polymerization inhibitor): 0.1 part

The above materials were then added, the pressure inside the reaction tank was lowered to 8.3 kPa, and the temperature was maintained at 160° C. as the mixture was reacted for 15 hours. The temperature was lowered to stop the reaction (second reaction step) and obtain an amorphous resin A2. The resulting amorphous resin A2 had a peak molecular weight Mp of 11000, a glass transition temperature Tg of 58° C., and an acid value of 20.0 mg KOH/g.

Manufacturing Examples of Amorphous Resins A3 to A5

Amorphous resins A3 to A5 were obtained as in the manufacturing example of the amorphous resin A2 except that the alcohol component or carboxylic acid component and the molar ratios were changed as shown in Table 3. During this process, the mass parts of the raw materials were adjusted so that the total moles of the alcohol and carboxylic acid components were the same as in the manufacturing example of the amorphous resin A1. The physical properties shown in Table 3.

TABLE 3

| Amorphous resin | Alcohol | | Acid | | | | | Physical properties | | |
|---|---|---|---|---|---|---|---|---|---|---|
| (Polyester resin) | BPA-PO (2.2) | EG | Terephthalic acid | Trimellitic acid | Succinic acid C4 | Adipic acid C6 | Sebacic acid C10 | Mp | Tg | Acid value |
| A2 | 100 mol % | | 45 mol % | 25 mol % | | 30 mol % | | 11000 | 58 | 20.0 |
| A3 | 100 mol % | | 75 mol % | | 15 mol % | | 10 mol % | 6200 | 54 | 5.0 |
| A4 | 70 mol % | 30 mol % | 45 mol % | 25 mol % | | 30 mol % | | 9000 | 57 | 36.0 |
| A5 | 100 mol % | | 15 mol % | 25 mol % | | 60 mol % | | 15000 | 54 | 45.0 |

The abbreviations in the table are defined as follows.
BPA-PO (2.2): Bisphenol A propylene oxide 2.2-mol adduct
EG: Ethylene glycol The Tg is given in units of ° C. and the acid value in units of mg KOH/g.

Manufacturing Example of Amorphous Resin A6

50.0 parts of xylene were loaded into an autoclave, nitrogen was substituted, and the temperature was raised to 180° C. under stirring in a sealed state.

A mixed solution of 81.9 parts of styrene, 7.0 parts of n-butyl acrylate, 10.0 parts of dodecyl acrylate, 1.1 parts of divinyl benzene, 1.0 part of di-tert-butyl peroxide and 20.0 parts of xylene was then dripped in and polymerized continuously for 5 hours with the temperature inside the autoclave controlled at 180° C.

This was then maintained for 1 hour at the same temperature to complete polymerization, and the solvent was removed to obtain an amorphous resin A6. The resulting amorphous resin A6 had a peak molecular weight Mp of 17000, a glass transition temperature Tg of 60° C., and an acid value of 0.0 mg KOH/g.

Manufacturing Example of Binder Resin 1 [Crosslinked Resin]

40 parts of the amorphous resin A1 were mixed with 60 parts of the crystalline resin C1 and supplied at a rate of 52 kg/hour to a twin-screw kneader (Kurimoto Ltd. S5KRC kneader), while at the same time 1.0 part of t-butyl peroxyisopropyl monocarbonate was supplied as a radical reaction initiator at a rate of 0.52 kg/hour, and the mixture was kneaded and extruded at 160° C., 90 rpm for 7 minutes to perform a crosslinking reaction, and then further mixed as the organic solvent was removed by depressurizing at 10 kPa from the vent mouth. The mixed product was cooled, and then coarsely crushed to not more than 1 mm in a hammer mill to obtain a binder resin 1.

Manufacturing Examples of Binder Resins 2 to 25

Binder resins 2 to 25 were manufactured by the same manufacturing methods as in the binder resin 1 manufacturing example except that the resins used, the presence or absence of a radical reaction initiator, and the rotation speed of the twin-screw kneader were changed. The formulations and manufacturing conditions are shown in Table 4.

TABLE 4

| Binder resin No. | Resin 1 Crystalline resin | Parts | Resin 2 Amorphous resin | Parts | Additive | Manufacturing conditions |
|---|---|---|---|---|---|---|
| 1 | C1 | 60 | A1 | 40 | Radical reaction initiator | 90 rpm |
| 2 | C1 | 60 | A2 | 40 | Radical reaction initiator | 90 rpm |
| 3 | C1 | 60 | A2 | 40 | None | 90 rpm |
| 4 | C2 | 60 | A2 | 40 | None | 90 rpm |
| 5 | C3 | 60 | A2 | 40 | None | 90 rpm |
| 6 | C1 | 60 | A2 | 40 | None | 120 rpm |
| 7 | C1 | 60 | A2 | 40 | None | 60 rpm |
| 8 | C1 | 60 | A2 | 40 | None | 150 rpm |
| 9 | C1 | 60 | A2 | 40 | None | 40 rpm |
| 10 | C1 | 85 | A2 | 15 | None | 40 rpm |
| 11 | C1 | 33 | A2 | 67 | None | 40 rpm |
| 12 | C1 | 90 | A2 | 10 | None | 40 rpm |
| 13 | C1 | 30 | A2 | 70 | None | 40 rpm |
| 14 | C4 | 90 | A3 | 10 | None | 40 rpm |
| 15 | C5 | 90 | A4 | 10 | None | 40 rpm |
| 16 | C6 | 90 | A2 | 10 | None | 40 rpm |
| 17 | C7 | 90 | A2 | 10 | None | 40 rpm |
| 18 | C1 | 95 | A2 | 5 | None | 40 rpm |
| 19 | C1 | 25 | A2 | 75 | None | 40 rpm |
| 20 | C1 | 10 | A2 | 90 | None | 40 rpm |
| 21 | C8 | 90 | A2 | 10 | None | 40 rpm |
| 22 | C9 | 90 | A2 | 10 | None | 40 rpm |
| 23 | C10 | 90 | A5 | 10 | None | 40 rpm |
| 24 | C11 | 90 | A2 | 10 | None | 40 rpm |
| 25 | C12 | 90 | A6 | 10 | None | 40 rpm |

Toner 1 Manufacturing Example

| | |
|---|---|
| Binder resin 1 | 100 parts |
| Aliphatic hydrocarbon compound HNP-51 (Nippon Seiro Co., Ltd.) | 10 parts |
| C.I. pigment blue 15:3 | 6.5 parts |
| Aluminum 3,5-di-t-butyl salicylate | 0.5 parts |

These materials were mixed at a rotation speed of 20 $s^{-1}$ for a rotation time of 5 minutes with a Henschel mixer (FM-75, Nippon Coke & Engineering Co., Ltd.), and then kneaded with a twin-screw kneader (PCM-30, Ikegai Corporation) set to 120 ° C. and a screw rotation of 200 rpm at a discharge temperature of 135° C. The kneaded product was cooled at a rate of 15° C./minute, and coarsely crushed to not more than 1 mm in a hammer mill to obtain a crushed product. The crushed product was then finely pulverized with a mechanical pulverizer (T-250, Freund Turbo Corporation).

This was then classified with a Faculty F-300 (Hosokawa Micron Corporation) to obtain a toner particle 1. The operating conditions were a classifying rotor speed of 130 $s^{-1}$ and a distributed rotor speed of 120 $s^{-1}$.

The following materials were then mixed at a rotation speed of 30 $s^{-1}$ for a rotation time of 10 minutes with an FM-10C. Henschel mixer (Mitsui Miike Machinery Co., Ltd.) to obtain a toner 1.

| | |
|---|---|
| Toner particle 1 | 100 parts |
| Fine particle 1 | 2.5 parts |
| Fine particle 12 | 0.8 parts |

The toner 1 had a weight-average particle diameter (D4) of 5.4 μm,

Manufacturing Examples of Toners 2 to 33.

Toners 2 to 33 were manufactured by changing the binder resin, kneading screw rotation speed and fine particle in the manufacturing example of the toner 1.

The formulations and toner manufacturing conditions tier the toners 1 to 33 are shown in Table 5.

When the resulting toners were observed in cross-section, the toners 1 to 25, 28 and 30 to 33 exhibited domain-matrix structures composed of a matrix containing the first resin (crystalline resin) and domains containing the second resin (amorphous resin).

Meanwhile, the toners 26 and 27 exhibited domain-matrix structures composed of a matrix containing the second resin and domains containing the first resin. The toner 29 did not have a domain-matrix structure.

TABLE 5

| Toner No. | Binder resin | Kneading rotation speed | Fine particle | Parts | Fine particle | Parts |
|---|---|---|---|---|---|---|
| 1 | Binder resin 1 | 200 rpm | Fine particle 1 | 2.5 | Fine particle 12 | 0.8 |
| 2 | Binder resin 2 | 200 rpm | Fine particle 1 | 2.5 | Fine particle 12 | 0.8 |
| 3 | Binder resin 3 | 200 rpm | Fine particle 1 | 2.5 | Fine particle 12 | 0.8 |
| 4 | Binder resin 3 | 200 rpm | Fine particle 2 | 2.5 | Fine particle 12 | 0.8 |
| 5 | Binder resin 4 | 200 rpm | Fine particle 3 | 2.5 | Fine particle 12 | 0.8 |
| 6 | Binder resin 4 | 200 rpm | Fine particle 4 | 2.5 | Fine particle 12 | 0.8 |
| 7 | Binder resin 5 | 200 rpm | Fine particle 5 | 2.5 | Fine particle 12 | 0.8 |
| 8 | Binder resin 3 | 200 rpm | Fine particle 6 | 2.5 | Fine particle 12 | 0.8 |
| 9 | Binder resin 3 | 200 rpm | Fine particle 7 | 2.5 | Fine particle 12 | 0.8 |
| 10 | Binder resin 3 | 200 rpm | Fine particle 8 | 2.5 | Fine particle 12 | 0.8 |
| 11 | Binder resin 3 | 200 rpm | Fine particle 9 | 2.5 | Fine particle 12 | 0.8 |
| 12 | Binder resin 3 | 200 rpm | Fine particle 10 | 2.5 | Fine particle 12 | 0.8 |
| 13 | Binder resin 6 | 350 rpm | Fine particle 10 | 2.5 | Fine particle 12 | 0.8 |
| 14 | Binder resin 7 | 160 rpm | Fine particle 10 | 2.5 | Fine particle 12 | 0.8 |
| 15 | Binder resin 8 | 400 rpm | Fine particle 10 | 2.5 | Fine particle 12 | 0.8 |
| 16 | Binder resin 9 | 140 rpm | Fine particle 10 | 2.5 | Fine particle 12 | 0.8 |
| 17 | Binder resin 10 | 140 rpm | Fine particle 10 | 2.5 | Fine particle 12 | 0.8 |
| 18 | Binder resin 11 | 140 rpm | Fine particle 10 | 2.5 | Fine particle 12 | 0.8 |
| 19 | Binder resin 12 | 140 rpm | Fine particle 10 | 2.5 | Fine particle 12 | 0.8 |
| 20 | Binder resin 13 | 140 rpm | Fine particle 10 | 2.5 | Fine particle 12 | 0.8 |
| 21 | Binder resin 14 | 140 rpm | Fine particle 10 | 2.5 | Fine particle 12 | 0.8 |
| 22 | Binder resin 15 | 140 rpm | Fine particle 10 | 2.5 | Fine particle 12 | 0.8 |
| 23 | Binder resin 16 | 140 rpm | Fine particle 10 | 2.5 | Fine particle 12 | 0.8 |
| 24 | Binder resin 17 | 140 rpm | Fine particle 10 | 2.5 | Fine particle 12 | 0.8 |
| 25 | Binder resin 18 | 140 rpm | Fine particle 10 | 2.5 | Fine particle 12 | 0.8 |
| 26 | Binder resin 19 | 140 rpm | Fine particle 10 | 2.5 | Fine particle 12 | 0.8 |
| 27 | Binder resin 20 | 140 rpm | Fine particle 10 | 2.5 | Fine particle 12 | 0.8 |
| 28 | Binder resin 21 | 140 rpm | Fine particle 10 | 2.5 | Fine particle 12 | 0.8 |
| 29 | Binder resin 22 | 140 rpm | Fine particle 10 | 2.5 | Fine particle 12 | 0.8 |
| 30 | Binder resin 23 | 140 rpm | Fine particle 10 | 2.5 | Fine particle 12 | 0.8 |
| 31 | Binder resin 24 | 140 rpm | Fine particle 10 | 2.5 | Fine particle 12 | 0.8 |
| 32 | Binder resin 12 | 140 rpm | Fine particle 11 | 2.5 | Fine particle 12 | 0.8 |
| 33 | Binder resin 25 | 140 rpm | Fine particle 10 | 2.5 | Fine particle 12 | 0.8 |

TABLE 6

| | X | Y/X | Domain diameter (μm) | Cx/Cy |
|---|---|---|---|---|
| Toner 1 | 54 | 0.62 | 1.00 | 2.8 |
| Toner 2 | 54 | 0.62 | 1.00 | 2.8 |
| Toner 3 | 60 | 0.66 | 1.00 | 2.8 |
| Toner 4 | 60 | 0.66 | 1.00 | 1.2 |
| Toner 5 | 60 | 0.66 | 1.00 | 4.5 |
| Toner 6 | 60 | 0.66 | 1.00 | 0.8 |

TABLE 6-continued

| | X | Y/X | Domain diameter (μm) | Cx/Cy |
|---|---|---|---|---|
| Toner 7 | 60 | 0.66 | 1.00 | 6.0 |
| Toner 8 | 60 | 0.66 | 1.00 | 22.0 |
| Toner 9 | 60 | 0.66 | 1.00 | 0.8 |
| Toner 10 | 60 | 0.66 | 1.00 | — |
| Toner 11 | 60 | 0.66 | 1.00 | — |
| Toner 12 | 60 | 0.66 | 1.00 | — |
| Toner 13 | 60 | 0.66 | 0.10 | — |
| Toner 14 | 60 | 0.66 | 2.00 | — |
| Toner 15 | 60 | 0.66 | 0.07 | — |
| Toner 16 | 60 | 0.66 | 2.20 | — |
| Toner 17 | 85 | 0.17 | 2.20 | — |
| Toner 18 | 33 | 1.94 | 2.20 | — |
| Toner 19 | 90 | 0.11 | 2.20 | — |
| Toner 20 | 30 | 2.33 | 2.20 | — |
| Toner 21 | 90 | 0.11 | 2.20 | — |
| Toner 22 | 90 | 0.11 | 2.20 | — |
| Toner 23 | 90 | 0.11 | 2.20 | — |
| Toner 24 | 90 | 0.11 | 2.20 | — |
| Toner 25 | 95 | 0.05 | 2.20 | — |

TABLE 6-continued

| | X | Y/X | Domain diameter (μm) | Cx/Cy |
|---|---|---|---|---|
| Toner 26 | 25 | 3.00 | 2.20 | — |
| Toner 27 | 10 | 9.00 | 2.20 | — |
| Toner 28 | 90 | 0.11 | 2.20 | — |
| Toner 29 | 90 | 0.11 | — | — |
| Toner 30 | 90 | 0.11 | 2.20 | — |
| Toner 31 | 90 | 0.11 | 2.20 | — |

TABLE 6-continued

| | X | Y/X | Domain diameter (μm) | Cx/Cy |
|---|---|---|---|---|
| Toner 32 | 90 | 0.11 | 2.20 | — |
| Toner 33 | 90 | 0.11 | 2.20 | — |

In the table, X is the content (mass %) of the first resin in the binder resin. The domain diameter is the number-average diameter in μm.

The binder resins of toner 1 and toner 2 each contained 12 mass % of a third resin.

Manufacturing Example of Magnetic Carrier 1

Magnetite 1 number-average particle diameter of 0.30 μm (magnetization strength 65 $Am^2/kg$ in $1000/4_\pi$ (kA/m) magnetic field)

Magnetite 2 with number average particle diameter of 0.50 μm (magnetization strength 65 $Am^2/kg$ in $1000/4_\pi$ (kA/m) magnetic field)

4.0 parts of a silane compound (3-(2-aminoethylammopropyl)trimethoxysilane) were added to 100 parts each of the above materials, and mixed and stirred at high speed at 100° C. or more in a vessel to treat the respective fine particles.

Phenol: 10 mass %

Formaldehyde solution: 6 mass % (formaldehyde 40 mass %, methanol 10 mass %, water 50 mass %)

Magnetite 1 treated with silane compound: 58 mass %

Magnetite 2 treated with silane compound: 26 mass %

100 parts of these materials, 5 parts of 28 mass % aqueous ammonia solution and 20 parts of water were placed in a flask, and stirred and mixed as the temperature was raised to 85° C. for 30 minutes, and maintained for 3 hours to perform a polymerization reaction, and the resulting phenol resin was hardened.

The hardened phenol resin was then c ruled to 30° C., water was added, the supernatant was removed, and the precipitate was water washed and air dried. This was then dried at 60° C. under reduced pressure (5 mmHg or less) to obtain a magnetic dispersion-type spherical magnetic carrier. The volume-based 50% particle diameter (D50) was 34.2 μm.

Manufacturing Example of Two-Component Developer 1

91.0 parts of the magnetic carrier 1 and 9.0 parts of the toner 1 were mixed with a YS-LD shaker (Yayoi Co., Ltd.) to obtain a two-component developer 1.

Manufacturing Examples of Two-Component Developers 2 to 33

Two-component developers 2 to 33 were obtained as in the manufacturing example of the two-component developer 1 except that the toners were changed as shown in Table 7.

TABLE 7

| Toner No. | Carrier No. | Two-component developer No. |
|---|---|---|
| Toner 1 | Carrier 1 | Two-component developer 1 |
| Toner 2 | Carrier 1 | Two-component developer 2 |
| Toner 3 | Carrier 1 | Two-component developer 3 |
| Toner 4 | Carrier 1 | Two-component developer 4 |
| Toner 5 | Carrier 1 | Two-component developer 5 |
| Toner 6 | Carrier 1 | Two-component developer 6 |
| Toner 7 | Carrier 1 | Two-component developer 7 |
| Toner 8 | Carrier 1 | Two-component developer 8 |
| Toner 9 | Carrier 1 | Two-component developer 9 |
| Toner 10 | Carrier 1 | Two-component developer 10 |
| Toner 11 | Carrier 1 | Two-component developer 11 |
| Toner 12 | Carrier 1 | Two-component developer 12 |
| Toner 13 | Carrier 1 | Two-component developer 13 |
| Toner 14 | Carrier 1 | Two-component developer 14 |
| Toner 15 | Carrier 1 | Two-component developer 15 |
| Toner 16 | Carrier 1 | Two-component developer 16 |
| Toner 17 | Carrier 1 | Two-component developer 17 |
| Toner 18 | Carrier 1 | Two-component developer 18 |
| Toner 19 | Carrier 1 | Two-component developer 19 |
| Toner 20 | Carrier 1 | Two-component developer 20 |
| Toner 21 | Carrier 1 | Two-component developer 21 |
| Toner 22 | Carrier 1 | Two-component developer 22 |
| Toner 23 | Carrier 1 | Two-component developer 23 |
| Toner 24 | Carrier 1 | Two-component developer 24 |
| Toner 25 | Carrier 1 | Two-component developer 25 |
| Toner 26 | Carrier 1 | Two-component developer 26 |
| Toner 27 | Carrier 1 | Two-component developer 27 |
| Toner 28 | Carrier 1 | Two-component developer 28 |
| Toner 29 | Carrier 1 | Two-component developer 29 |
| Toner 30 | Carrier 1 | Two-component developer 30 |
| Toner 31 | Carrier 1 | Two-component developer 31 |
| Toner 32 | Carrier 1 | Two-component developer 32 |
| Toner 33 | Carrier 1 | Two-component developer 33 |

Low-Temperature Fixability

Paper: GFC-081 (81.0 $g/m^2$, sold by Canon Marketing Japan Inc.)

Toner laid-on level of paper: 0.90 $mg/cm^2$ (Adjusted by adjusting voltage VDC of developer carrying member, charging voltage VD of electrostatic latent image bearing member, and laser power)

Evaluation image: 2 cm×5 cm image disposed in center of the A4 paper

Test environment: Low-temperature low-humidity environment of 15° C., 10% RH (hereunder "L/L")

Fixing temperature: 140° C.

Process speed: 400 mm/sec

The evaluation image was output and evaluated for low-temperature fixability. The value of the image density decrease rate was used as the evaluation benchmark for low-temperature fixability.

For the image density decrease rate, the image density in the center was first measured with an X-Rite color reflection densitometer (500 Series, X-Rite Inc.). At the part that had been measured for image density, the fixed image was then rubbed (5 passes) with Silbon paper under 4.9 kPa (50 $g/cm^2$) of load, and the image density was measured again.

The image density decrease rate after rubbing was then calculated by the following formula. The resulting image density decrease rate was then ranked according to the following evaluation standard. A rank of at least D means that the effects of the invention were obtained. The evaluation results are shown in Table 8.

Image density decrease rate=(image density before rubbing—image density after rubbing)/image density before rubbing×100

Evaluation Standard

AA: Image density decrease rate less than 1.5%

A: Image density decrease rate at least 1.5% and less than 3.0%

B: Image density decrease rate at least 3.0% and less than 4.5%

C: Image density decrease rate at least 4.5% and less than 6.0%

D: image density decrease rate at least 6.0% and less than 7.5%

E: Image density decrease rate at least 7.5%

Hot Offset Resistance

Paper: CS-064 (64.0 g/m$^2$, sold by Canon Marketing Japan Inc.)

Toner laid-on level on paper: 0.06 mg/cm$^2$ (Adjusted by adjusting DC voltage VDC of developer carrying member, charging voltage VD of electrostatic latent image bearing member, and laser power)

Evaluation image: 2 cm×20 cm image disposed on long edge of above A4 paper in direction of paper feed leaving 2 mm margin at leading edge Test environment: Normal-temperature low-humidity environment of 23° C., 5% RH (hereunder "N/L")

Fixing temperature: Raised in 5° C. increments front 140° C.

Process speed: 400 mm/sec

The evaluation image was output, and hot offset resistance was evaluated based on the maximum fixing temperature at which no offset occurred. A rank of at least D means that the effects of the invention were obtained.

Evaluation Standard

AA: At least 180° C.

A. At least 170° C. and less than 180° C.

B: At least 160° C. and less than 170° C.

C: At least 150° C. and less than 160° C.

D: At least 140° C. and less than 150° C.

E: Less than 140° C.

Image Resolution (Fine Line Reproducibility)

Using an imagePress C800 Canon full-color copier as the image-forming apparatus, the cyan developing device of the image-forming apparatus was filled with the above two-component developer, the cyan toner container was filled with the above toner, and the following evaluations were performed.

As a modification, the mechanism for removing excess magnetic carrier from the developing device was removed. GF-C081 plain paper (A4, basis weight 81.4 g/m$^2$, sold by Canon Marketing Japan Inc.) was used as the evaluation paper.

The apparatus was adjusted so that the toner laid-on level of an FFh image (solid image) was 0.45 mg/cm$^2$. Based on a system of 256 gradations displayed in hexadecimal notation, 00h represents the first of the 256 gradations (white part), and FFh represents the 256th gradation (solid part).

An image output test was first performed by printing 500 sheets of a horizontal ruled line image with an image ratio of 0.1% in an environmental test chamber set to room temperature 23° C., 5% RH (N/L environment). During continues paper feed of 500 sheets, the same developing conditions and transfer conditions (no calibration) were maintained as for the first sheet.

The environmental test chamber was then set to room temperature 30°, 80% RH (H/H environment), and a roughly 40 μm-wide line image was output, corresponding to an image resolution of 600 dpi.

The environmental test chamber was then reset to room temperature 23° C., 5% RH (N/L environment), and a roughly 40 μm-wide line image was output, corresponding to an image resolution of 600 dpi.

The resulting line images from the two environments were evaluated according to the following standard based on the standard deviation σ of multiple measurements of the line width made with a PIAS-II personal image quality evaluation system (QEA Inc.). A rank of at least D means that the effects of the invention were obtained.

AA: Less than 3.0 μm

A: At least 3.0 μm and less than 4.0 μm

B: At least 4.0 μm and less than 5.0 μm

C: At least 5.0 μm and less than 6.0 μm

D: At least 6.0 μm and less than 7.0 μm

E: At least 7.0 μm

Examples 1 to 25 and Comparative Examples 1 to 8

The above evaluations were performed using the resulting two-component developers 1 to 33. The results are shown in Table 8.

TABLE 8

| Example | Two-component developer | Fixing performance | | | | Fine line reproducibility | | | |
|---|---|---|---|---|---|---|---|---|---|
| | | Low temperature | | High temperature | | HH | | NL | |
| No. | No. | % | Rank | ° C. | Rank | μm | Rank | μm | Rank |
| 1 | 1 | 0.7 | AA | 205 | AA | 2.0 | AA | 1.7 | AA |
| 2 | 2 | 0.9 | AA | 200 | AA | 2.5 | AA | 3.1 | A |
| 3 | 3 | 1.1 | AA | 195 | AA | 3.4 | A | 3.3 | A |
| 4 | 4 | 1.2 | AA | 190 | AA | 3.6 | A | 3.4 | A |
| 5 | 5 | 1.3 | AA | 190 | AA | 3.8 | A | 3.8 | A |
| 6 | 6 | 1.3 | AA | 190 | AA | 3.7 | A | 4.3 | B |
| 7 | 7 | 1.3 | AA | 190 | AA | 3.9 | A | 4.7 | B |
| 8 | 8 | 1.3 | AA | 185 | AA | 4.4 | B | 4.6 | B |
| 9 | 9 | 1.3 | AA | 190 | AA | 4.6 | B | 4.7 | B |
| 10 | 10 | 1.2 | AA | 185 | AA | 5.5 | C | 4.9 | B |
| 11 | 11 | 1.2 | AA | 190 | AA | 4.2 | B | 5.3 | C |
| 12 | 12 | 1.1 | AA | 195 | AA | 5.7 | C | 5.6 | C |
| 13 | 13 | 1.2 | AA | 185 | AA | 5.3 | C | 5.4 | C |
| 14 | 14 | 1.1 | AA | 185 | AA | 5.6 | C | 5.5 | C |
| 15 | 15 | 1.8 | A | 180 | AA | 5.5 | C | 5.3 | C |
| 16 | 16 | 1.7 | A | 175 | A | 5.1 | C | 5.7 | C |
| 17 | 17 | 1.7 | A | 170 | A | 5.3 | C | 5.6 | C |
| 18 | 18 | 2.9 | A | 175 | A | 5.8 | C | 5.9 | C |
| 19 | 19 | 1.6 | A | 160 | B | 5.8 | C | 5.9 | C |
| 20 | 20 | 4.4 | B | 170 | A | 5.7 | C | 5.6 | C |
| 21 | 21 | 2.4 | A | 165 | B | 5.6 | C | 6.1 | D |
| 22 | 22 | 2.2 | A | 165 | B | 6.1 | D | 5.3 | C |
| 23 | 23 | 2.7 | A | 165 | B | 5.6 | C | 5.5 | C |
| 24 | 24 | 2.6 | A | 155 | C | 5.5 | C | 6.6 | D |
| 25 | 25 | 1.8 | A | 150 | C | 5.4 | C | 5.8 | C |
| C.E. 1 | 26 | 7.6 | E | 170 | A | 6.7 | D | 6.3 | D |
| C.E. 2 | 27 | 7.7 | E | 175 | A | 7.1 | E | 7.7 | E |

TABLE 8-continued

| Example No. | Two-component developer No. | Fixing performance Low temperature % | Rank | High temperature ° C. | Rank | Fine line reproducibility HH μm | Rank | NL μm | Rank |
|---|---|---|---|---|---|---|---|---|---|
| C.E. 3 | 28 | 8.5 | E | 165 | B | 6.9 | D | 6.7 | D |
| C.E. 4 | 29 | 9.6 | E | 175 | A | 6.6 | D | 6.6 | D |
| C.E. 5 | 30 | 1.9 | A | 160 | B | 7.4 | E | 6.8 | D |
| C.E. 6 | 31 | 7.5 | E | 165 | B | 7.5 | E | 7.4 | E |
| C.E. 7 | 32 | 1.7 | A | 165 | B | 9.0 | E | 8.8 | E |
| C.E. 8 | 33 | 3.4 | B | 150 | C | 7.8 | E | 7.5 | E |

In the Table, "C.E." denotes Comparative Example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-225293, filed Dec. 13, 2019, which is hereby incorporated by reference herein in its entirety.

What is claimed is:

1. A toner, comprising:

a toner particle containing a binder resin including a first resin and a second resin;

a fine particle on a surface of the toner particle, a surface of the fine particle having a compound containing nitrogen atoms bound or adsorbed thereto;

the first resin being a crystalline copolymer of monomers consisting of a (meth)acrylic acid ester having a $C_{18-36}$ alkyl group, acrylonitrile, styrene and acrylic acid, and having a first monomer unit represented by formula (1), a content ratio of the first monomer unit in the first resin being 30.0 to 85.0 mass %

(1)

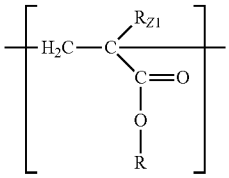

where $R_{Z1}$ represents a hydrogen atom or a methyl group, and R represents a $C_{18-36}$ alkyl group; and the second resin being an amorphous resin, wherein an acid value of the first resin is 0.1 to 30.0 mg KOH/g, an acid value of the second resin is 0.5 to 40.0 mg KOH/g, and a domain matrix structure formed of a matrix containing the first resin and domains containing the second resin appears in cross-sectional observation of the toner.

2. The toner according to claim 1, wherein a mass ratio Y/X of a content Y of the second resin in the binder resin to a content X of the first resin in the binder resin is 0.20 to 2.00.

3. The toner according to claim 1, wherein a number-average diameter of the domains in cross-sectional observation of the toner is 0.10 to 2.00 μm.

4. The toner according to claim 1, wherein the compound containing nitrogen atoms comprises an amino group.

5. The toner according to claim 1, wherein the compound containing nitrogen atoms comprises a quaternary ammonium group.

6. The toner according to claim 1, wherein the surface of the fine particle comprises a compound having a $C_{4-24}$ alkyl group.

7. The toner according to claim 6, wherein Cx/Cy is 1.0 to 5.0 when Cx is a carbon number of the alkyl group represented by R and Cy is a carbon number of the $C_{4-24}$ alkyl group.

8. The toner according to claim 1, wherein the binder resin further contains a third resin, and the third resin contains a resin where the first resin is linked to the second resin.

9. The toner according to claim 1, wherein the second resin comprises at least one member selected from the group consisting of polyester resins, vinyl resins, and hybrid resins in which vinyl resins are linked to polyester resins.

10. The toner according to claim 1, wherein a content of the first resin in the binder resin is at least 30.0 mass %.

11. The toner according to claim 1, wherein the first resin comprises a second monomer unit that is different from the first monomer unit and which is at least one member selected from the group consisting of formula (2) and formula (3)

(2)

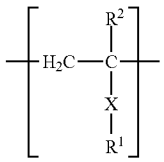

(3)

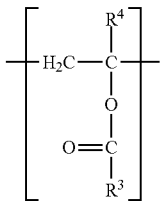

where X is a single bond or $C_{1-6}$ alkylene group, $R^1$ is —C≡N, —C(═O)NHR$^{10}$ ($R^{10}$ represents a hydrogen atom or $C_{1-4}$ alkyl group), a hydroxy group, —COOR$^{11}$ ($R^{11}$ represents a $C_{1-6}$ alkyl group or $C_{1-6}$ hydroxyalkyl group), —NH—C(═O)—N$(R^{13})_2$ ($R^{13}$s independently represent a hydrogen atom or $C_{1-6}$ alkyl group), —COO$(CH_2)_2$NHCOOR$^{14}$ ($R^{14}$ represents a $C_{1-4}$ alkyl group) or —COO$(CH_2)_2$—NH—C(═O)—N$(R^{15})_2$ ($R^{15}$s independently represent a hydrogen atom or $C_{1-6}$ alkyl group), $R^2$ represents a hydrogen atom or a methyl group, $R^3$ represents a $C_{1-4}$ alkyl group, and $R^4$ represents a hydrogen atom or a methyl group.

12. The toner according to claim 1, wherein the fine particle surface further comprises a silicon compound containing an alkyl group having no nitrogen atoms bound or adsorbed thereon.

* * * * *